US011382468B2

(12) United States Patent
Shin et al.

(10) Patent No.: US 11,382,468 B2
(45) Date of Patent: Jul. 12, 2022

(54) CLEANER

(71) Applicant: LG ELECTRONICS INC., Seoul (KR)

(72) Inventors: Jinhyouk Shin, Seoul (KR); Moohyun Ko, Seoul (KR); Namil Woo, Seoul (KR); Donggeun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/896,078

(22) Filed: Jun. 8, 2020

(65) Prior Publication Data

US 2021/0022573 A1 Jan. 28, 2021

(30) Foreign Application Priority Data

Jul. 24, 2019 (KR) ..... 10-2019-0089625

(51) Int. Cl.
*A47L 9/04* (2006.01)
*A47L 5/30* (2006.01)
(Continued)

(52) U.S. Cl.
CPC ..... *A47L 9/0477* (2013.01); *A47L 5/30* (2013.01); *A47L 9/009* (2013.01); *A47L 9/0411* (2013.01); *A47L 9/06* (2013.01); *A47L 9/1683* (2013.01)

(58) Field of Classification Search
CPC ..... A47L 9/0477; A47L 9/0411; A47L 9/06; A47L 9/009; A47L 9/1683; A47L 9/0072; A47L 9/2889; A47L 9/02; A47L 9/04; A47L 9/0405; A47L 9/062; A47L 9/0626; A47L 9/0633; A47L 9/066; A47L 9/0666;
(Continued)

(56) References Cited

U.S. PATENT DOCUMENTS 4,817,233 A 4/1989 Waldhauser
10,299,644 B2 * 5/2019 Genn ..... A47L 9/0411
(Continued)

FOREIGN PATENT DOCUMENTS

JP 2010-88597 A 4/2010
JP 2014-212829 A 11/2014
(Continued)

OTHER PUBLICATIONS

Machine Translation of KR101413259 (Year: 2014).*
International Search Report from PCT/KR2020/007656, dated Nov. 27, 2020.

*Primary Examiner* — Orlando E Aviles
*Assistant Examiner* — Jacob Adam Montgomery
(74) *Attorney, Agent, or Firm* — Dentons US LLP

(57) ABSTRACT

Provided is a vacuum cleaner. The vacuum cleaner includes a cleaner body provided with a suction motor at the inside thereof and a handle at the outside thereof, and a suction nozzle connected to the cleaner body. The suction nozzle includes a housing of which at least a portion of a front side is opened to defined a front opening, a rotation cleaning part which is installed inside the housing, of which at least a portion is exposed through the front opening, and which is configured to clean a floor surface by a rotation operation thereof, and a sealing part protruding downward from a lower end of the housing and provided in rear of the front opening.

17 Claims, 23 Drawing Sheets
(4 of 23 Drawing Sheet(s) Filed in Color)

(51) Int. Cl.
*A47L 9/06* (2006.01)
*A47L 9/00* (2006.01)
*A47L 9/16* (2006.01)

(58) Field of Classification Search
CPC ..... A47L 9/0673; A47L 7/30; A47L 7/009; A47L 7/0009; A47L 7/0042; A47L 5/26; A47L 11/4036
USPC ..... 15/363, 371, 383, 399, 420
See application file for complete search history.

(56) References Cited

U.S. PATENT DOCUMENTS

| | | | | |
|---|---|---|---|---|
| 2016/0270610 | A1 | 9/2016 | Kasper | |
| 2017/0079493 | A1 | 3/2017 | Genn et al. | |
| 2019/0150686 | A1* | 5/2019 | Horne | A47L 9/02 |

FOREIGN PATENT DOCUMENTS

| | | | |
|---|---|---|---|
| JP | 2019-514661 | A | 6/2019 |
| KR | 10-1413259 | B1 | 7/2014 |
| KR | 10-2018-0044366 | A | 5/2018 |

* cited by examiner (a)

(b)

(a)

(b)

| case | L | g | H | R | K | h | a | b | Pressure Drop [Pa] |
|---|---|---|---|---|---|---|---|---|---|
| 1 | 16 | 1.5 | 2.5 | 0.4 | 0 | 0 | 0 | 0 | 32.5 |
| 2 | 16 | 1.5 | 2.5 | 0.4 | 4 | 0.9 | 2.9 | 1.5 | 74.9 |
| 3 | 16 | 1.5 | 2.5 | 0.4 | 4 | 0.9 | 2.3 | 2.3 | 84.7 |
| 4 | 16 | 1.5 | 2.5 | 0.4 | 4 | 0.9 | 1.6 | 3.2 | 96.0 |
| 5 | 16 | 1.5 | 2.5 | 0.4 | 4 | 1.9 | 2.9 | 1.5 | 73.1 |
| 6 | 16 | 1.5 | 2.5 | 0.4 | 4 | 1.9 | 2.3 | 2.3 | 78.5 |
| 7 | 16 | 1.5 | 2.5 | 0.4 | 4 | 1.9 | 1.6 | 3.2 | 84.4 |
| 8 | 16 | 1.5 | 2.5 | 0.4 | 4 | 2.9 | 2.9 | 1.5 | 73.4 |
| 9 | 16 | 1.5 | 2.5 | 0.4 | 4 | 2.9 | 2.3 | 2.3 | 78.5 |
| 10 | 16 | 1.5 | 2.5 | 0.4 | 4 | 2.9 | 1.6 | 3.2 | 83.2 |
| 11 | 16 | 1.5 | 2.5 | 0.4 | 5 | 0.9 | 2.3 | 1.2 | 81.0 |
| 12 | 16 | 1.5 | 2.5 | 0.4 | 5 | 0.9 | 1.8 | 1.8 | 90.3 |
| 13 | 16 | 1.5 | 2.5 | 0.4 | 5 | 0.9 | 1.2 | 2.4 | 106.8 |
| 14 | 16 | 1.5 | 2.5 | 0.4 | 5 | 1.9 | 2.3 | 1.2 | 80.2 |
| 15 | 16 | 1.5 | 2.5 | 0.4 | 5 | 1.9 | 1.8 | 1.8 | 86.0 |
| 16 | 16 | 1.5 | 2.5 | 0.4 | 5 | 1.9 | 1.2 | 2.4 | 93.9 |
| 17 | 16 | 1.5 | 2.5 | 0.4 | 5 | 2.9 | 2.3 | 1.2 | 80.1 |
| 18 | 16 | 1.5 | 2.5 | 0.4 | 5 | 2.9 | 1.8 | 1.8 | 86.1 |
| 19 | 16 | 1.5 | 2.5 | 0.4 | 5 | 2.9 | 1.2 | 2.4 | 94.6 |

CLEANER

CROSS-REFERENCE TO RELATED APPLICATIONS

The present application claims priority under 35 U.S.C. 119 and 35 U.S.C. 365 to Korean Patent Application No. 10-2019-0089625, filed on Jul. 24, 2019, which is hereby incorporated by reference in its entirety.

BACKGROUND

The present disclosure relates to a structure that is capable of improving suction performance of a vacuum cleaner.

The vacuum cleaner refers to a device that suctions dust and air by using suction power generated by a suction motor mounted inside a cleaner body and separates the dust from the air to collect the dust.

Such vacuum cleaners are classified into a canister cleaner, an upright cleaner, a stick cleaner, a handy cleaner, and a robot cleaner. In the case of the canister cleaner, a suction nozzle for suctioning dust is provided separately from a cleaner body, and the cleaner body and the suction nozzle are connected to each other by a connection device. In the case of the upright cleaner, a suction nozzle is rotatably connected to a cleaner body. In the case of the stick cleaner and the handy cleaner, the stick cleaner and the handy cleaner are used in a state in which a user grips a cleaner body by his/her hand. However, in the case of the stick cleaner, a suction motor is disposed close to a suction nozzle (a lower center), and in the case of the handy cleaner, a suction motor is disposed close to a grip part (an upper center). The robot cleaner cleans itself while traveling by itself through an autonomous driving system.

The suction nozzle refers to a portion which touches the floor to directly suction dust and air. Suction force generated by the suction motor mounted inside the cleaner body is transmitted to the suction motor, and the dust and air are suctioned into the suction nozzle by the suction force.

The suction nozzle is provided with a rotation cleaning part (or an agitator). The rotation cleaning part rotates to scrape dust from the floor or carpet, thereby improving cleaning performance.

In addition, the user allows the suction nozzle to move forward and backward to suction dust on the floor surface. Here, the suction nozzle may be improved in suction performance only when the suction nozzle is maintained in close contact with the floor surface except for a space in which the dust is introduced.

In general, the suction nozzle defines a front opening through which dust is introduced.

Then, to clean the floor surface, when the suction force is generated in the suction nozzle, dust or the like is introduced through the front opening.

Here, a flow of air is generated forward from a rear side, and thus, the front suction force is reduced to deteriorate the cleaning performance.

A cleaner head having a rear portion and a side portion, which seals a side surface and a rear side of the cleaner head while moving with respect to the cleaner head is disclosed in Korean Patent Publication No. 10-2018-0044366 (May 2, 2018) among the prior art documents.

The patent has a structure in which the rear portion rotates with respect to a hinge axis, and the rear portion and the floor surface linearly contact each other in a straight-line shape. Therefore, when the cleaner performs a suction operation, there is a limit in blocking a flow of air flowing forward from the rear side through a space between the floor surface and the cleaner head.

SUMMARY

Embodiments provide a vacuum cleaner that is capable of preventing air from flowing forward from a rear side of a suction nozzle when suction force is generated in the suction nozzle.

Embodiments also provide a vacuum cleaner that is capable of preventing cleaning performance from being deteriorated while suction performance of a front opening is deteriorated.

Embodiments also provide a vacuum cleaner that is capable of preventing a stable time reduction and suction motor overload from occurring due to deterioration of suction performance.

Embodiments also provide a vacuum cleaner in which a flow of a fluid flowing forward from a rear side of a suction nozzle when the cleaner operates is not simply blocked, but multi-stage resistance is generated in a passage of the fluid flowing forward from the rear side to reduce a flow velocity and rate of the fluid flowing forward from the rear side, resulting in concentrating the suction force, thereby allowing the front suction force to increase.

In one embodiment, a vacuum cleaner includes a sealing part that comes into contact with a floor surface to block a flow of air flowing forward from a rear side when the cleaner operates and is provided with at least one air chamber recessed upward from a bottom surface thereof.

The vacuum cleaner may include a cleaner body provided with a suction motor at the inside thereof and a handle at the outside thereof and a suction nozzle connected to the cleaner body.

The suction nozzle may include a housing of which at least a portion of a front side is opened, and a rotation cleaning part is installed inside the housing, and at least a portion of the rotation cleaning part may be exposed through the front opening of the housing.

The sealing part may protrude downward from a lower end of the housing and be provided in rear of the front opening.

The sealing part may include at least one of a groove recessed upward from a lower end thereof or a protrusion protruding downward from the lower end thereof.

The sealing part may include a sealing groove recessed upward from the lower end thereof and extending parallel to a longitudinal direction of the suction nozzle.

The sealing groove may be provided in plurality, which are spaced apart from each other in a front-rear direction.

The sealing groove may have a height (h) in a range of about 0.5 mm to about 2 mm.

A sealing protrusion may be disposed between the sealing grooves.

A ratio (a/b) of a front-rear length (a) of the sealing protrusion and a front-rear length (b) of the sealing groove may be set in a range of about 0.3 to about 0.8.

A ratio (h/b) of a front-rear length (b) of the sealing groove and a height (h) of the sealing groove may be set in a range of about 0.2 to about 0.4.

A ratio (h/a) of a front-rear length (a) of the sealing protrusion and a height (h) of the sealing groove may be set in a range of about 0.5 to about 0.8.

The sealing part may include a sealing protrusion protruding downward from an upper side and extending parallel to a longitudinal direction of the suction nozzle.

The sealing protrusion may be provided in plurality, which are spaced apart from each other in a front-rear direction.

The sealing protrusion disposed at a rear side may further protrude than the sealing protrusion disposed at a front side.

The sealing part may be elevatably connected to a rear portion of the suction nozzle.

At least a portion of a rear side of the housing may be opened to define a rear opening.

The housing may include a first side surface configured to define the rear opening and a second side surface spaced backward from the first side surface to face the first side surface, and the sealing part may include a second extension portion and a first extension portion, which extend upward to be contact-supported on the first side surface and the second side surface, respectively.

The sealing part may be elevated in the state in which the second extension portion and the first extension portion contact the first side surface and the second side surface, respectively.

The sealing part may further include a third extension portion extending backward from a lower end of the second extension portion.

The third extension portion may be provided in a curved shape.

The sealing part may include a sealing pad configured to connect a lower end of the third extension portion to a lower end of the first extension portion, and a sealing groove recessed upward from a lower end of the sealing pad and extending parallel to a longitudinal direction of the suction nozzle may be defined in the sealing pad.

The rear opening may include a first rear opening and a second rear opening disposed behind the first rear opening.

The sealing part may include a first extension portion inserted into the first rear opening and a second extension portion inserted into the second rear opening.

A hook protrusion extending horizontally from each of both sides of an upper end of the first extension portion may be disposed on the first extension portion.

The elevation part may include a fixing hook constituted by a horizontal portion backward from an upper end of the second extension portion and a vertical portion extending downward from an end of the horizontal portion, and a hook groove recessed downward so that the fixing hook may be fitted into an inner surface thereof is defined in the housing.

The sealing part may include a sealing pad configured to connect a lower end of the first extension portion to a lower end of the second extension portion, and a sealing groove recessed upward from a lower end of the sealing pad and extending parallel to a longitudinal direction of the suction nozzle may be defined in the sealing pad.

The sealing groove may be provided in plurality, which are spaced apart from each other in a front-rear direction.

The sealing part may contact the floor surface while descending by a differential pressure when suction force is generated in the suction nozzle.

When the sealing part descends, a lower end of the sealing part may be disposed lower than a lower end of the front opening.

The sealing part may be made of a material having elasticity or flexibility.

The sealing part may be made of a rubber or silicon material.

In the suction nozzle, a connection tube connected to the cleaner body may be disposed behind the housing, and the sealing part may be disposed between the front opening and the connection tube.

The housing may include: a body part in which the front opening is defined in a front side thereof, and a chamber communicating with the front opening is provided therein and which is configured to cover an upper side of the rotation cleaning part; and a support member provided below the body part.

The sealing part may be provided on a bottom surface of the support member.

A front end of the body part and a front end of the support member may define the front opening.

The sealing part may have unevennesses on the bottom surface that contacts the floor surface.

The sealing part may extend in a left-right direction that is perpendicular to the front-rear direction in which the suction nozzle moves.

The unevennesses disposed on the bottom surface of the sealing part may alternately disposed in a direction parallel to the front-rear direction in which the suction nozzle moves.

The unevennesses disposed on the bottom surface of the sealing part may alternately disposed in a direction parallel to a flow direction of air suctioned into the suction nozzle.

The details of one or more embodiments are set forth in the accompanying drawings and the description below. Other features will be apparent from the description and drawings, and from the claims.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF THE EMBODIMENTS

Figure 1:
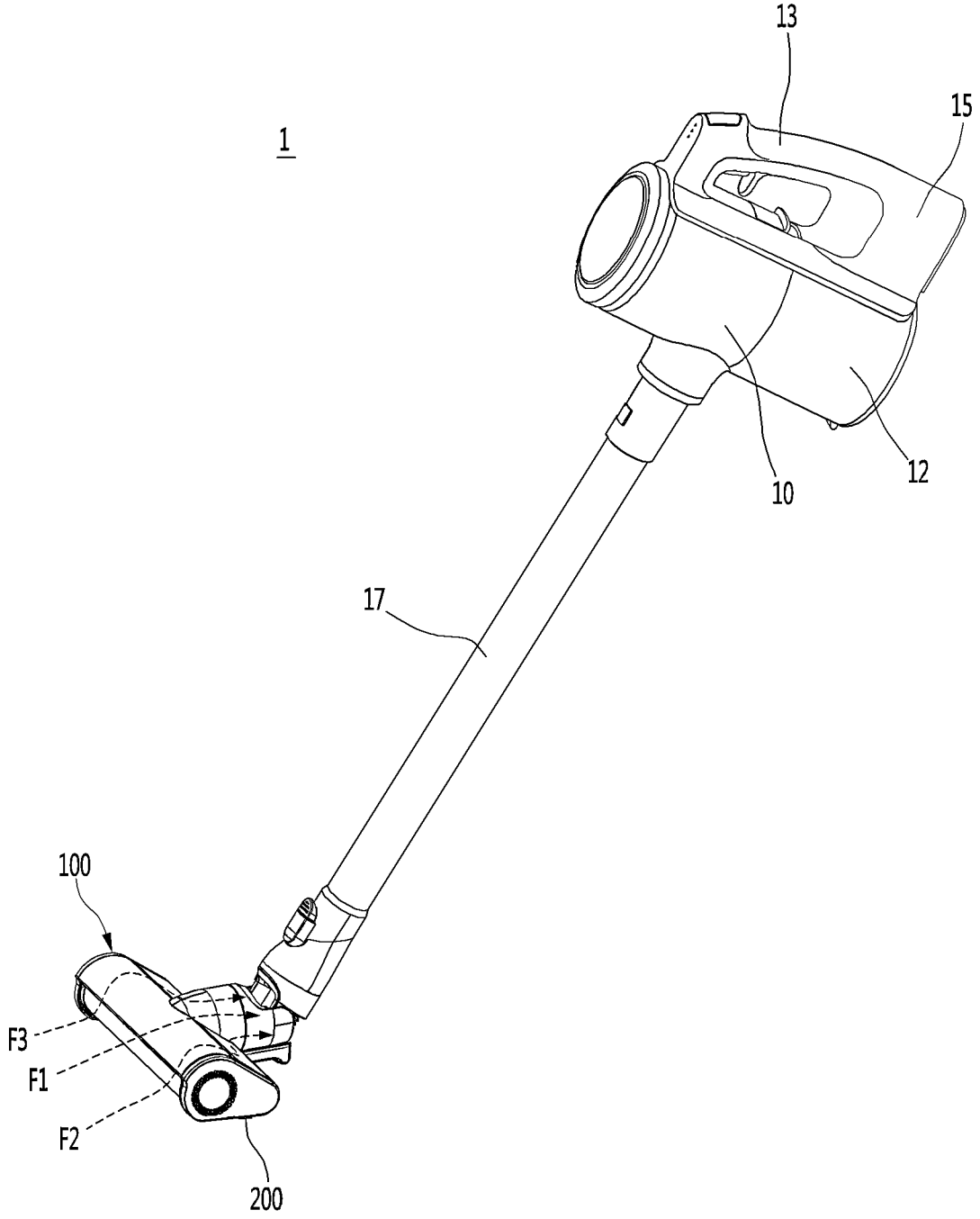
FIG. 1 is a perspective view of a vacuum cleaner according to an embodiment.

Hereinafter, some embodiments of the present invention will be described in detail with reference to the accompanying drawings. Exemplary embodiments of the present invention will be described below in more detail with reference to the accompanying drawings. It is noted that the same or similar components in the drawings are designated by the same reference numerals as far as possible even if they are shown in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

FIG. 1 is a perspective view of a vacuum cleaner according to an embodiment.

Referring to FIG. 1, a vacuum cleaner 1 according to an embodiment may include a cleaner body 10 provided with a suction motor (not shown) for generating suction force, a suction nozzle 100 suctioning air that contains dust, and an extension tube 17 connecting the cleaner body 10 to the suction nozzle 100.

Although not shown, the suction nozzle 100 may be directly connected to the cleaner body 10 without the extension tube 17.

The cleaner body 10 may include a dust container 12 in which the dusts separated from the air are stored. Accordingly, the dust introduced through the suction nozzle 100 may be stored in the dust container 12 through the extension tube 17.

A handle 13 to be gripped by a user may be provided outside the cleaner body 10. The user may perform cleaning while gripping the handle 13.

The cleaner body 10 may include a battery (not shown), and a battery accommodation part 15 in which the battery (not shown) is accommodated may be provided in the cleaner body 10. The battery accommodation part 15 may be provided below the handle 13. The battery (not shown) may be connected to the suction nozzle 100 to supply power to the suction nozzle 100.

Hereinafter, the suction nozzle 100 will be described in detail.

Figure 2:
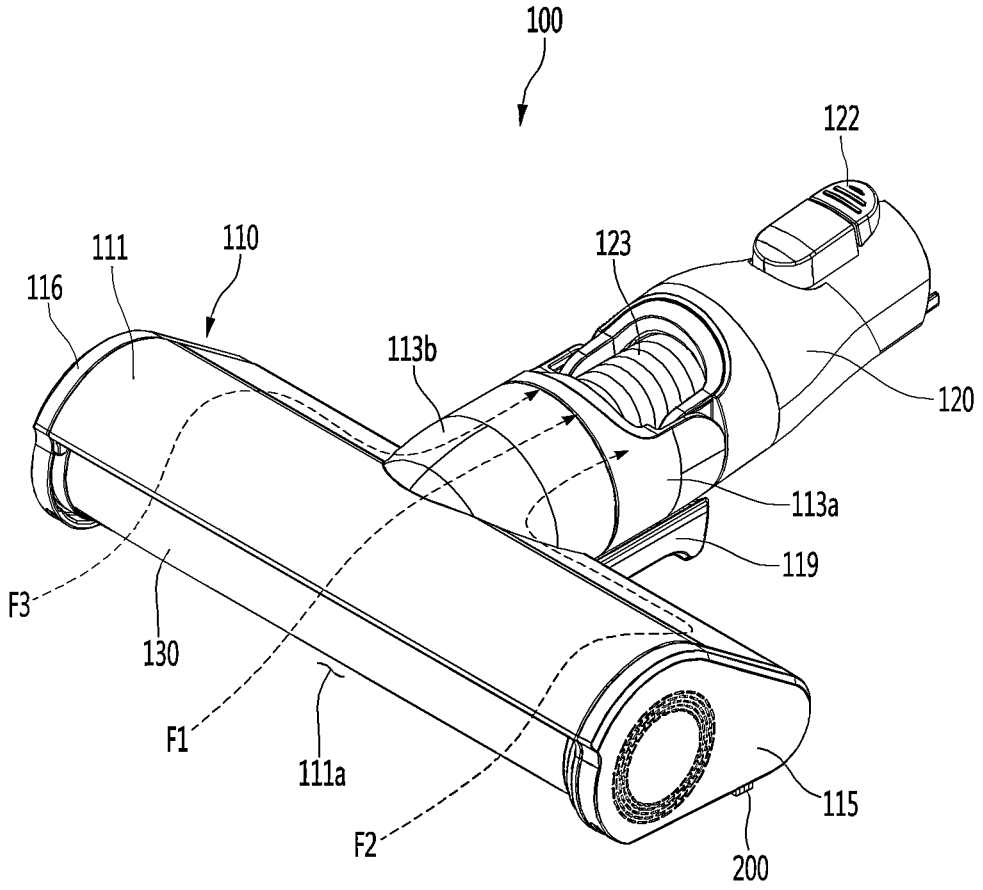
FIG. 2 is a perspective view of a suction nozzle of FIG. 1.
Figure 3:
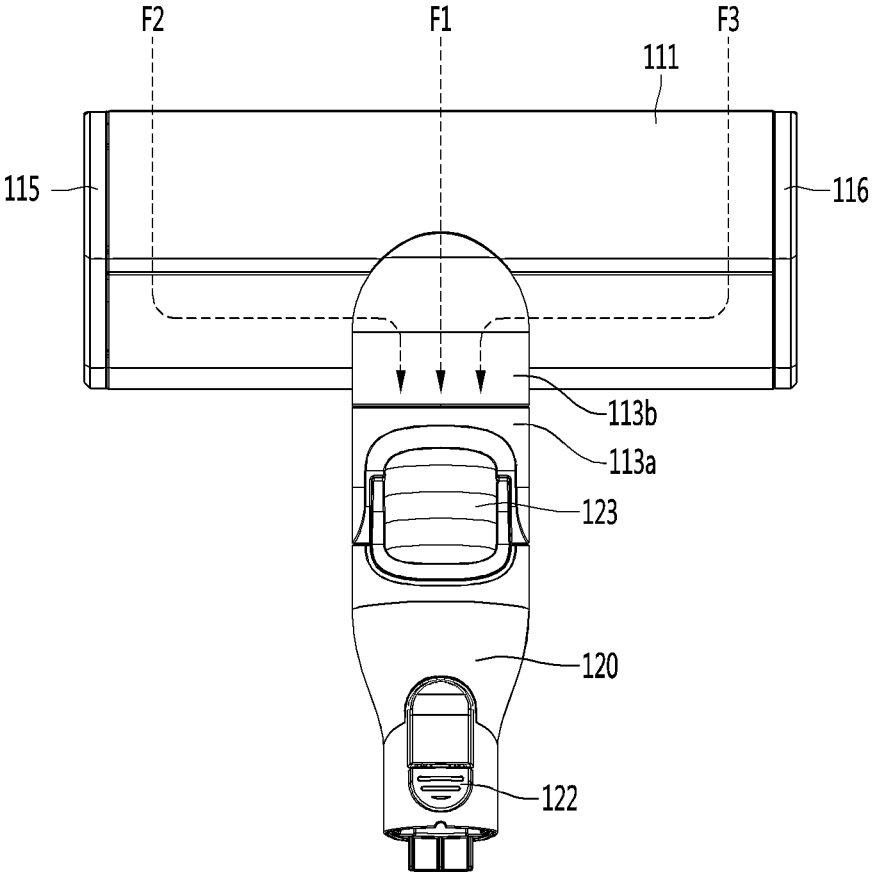
FIG. 3 is a plan view of the suction nozzle of FIG. 2.
Figure 4:
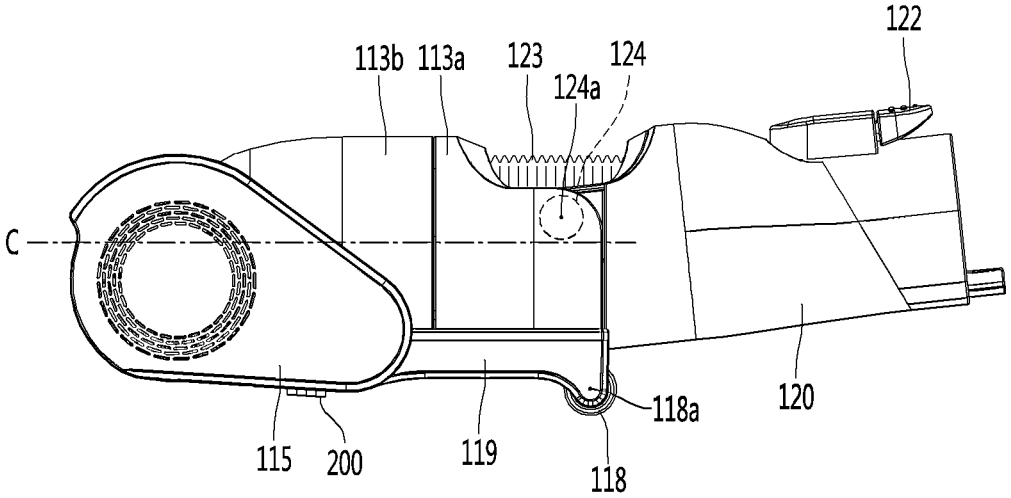
FIG. 4 is a side view of the suction nozzle of FIG. 1.
Figure 5:
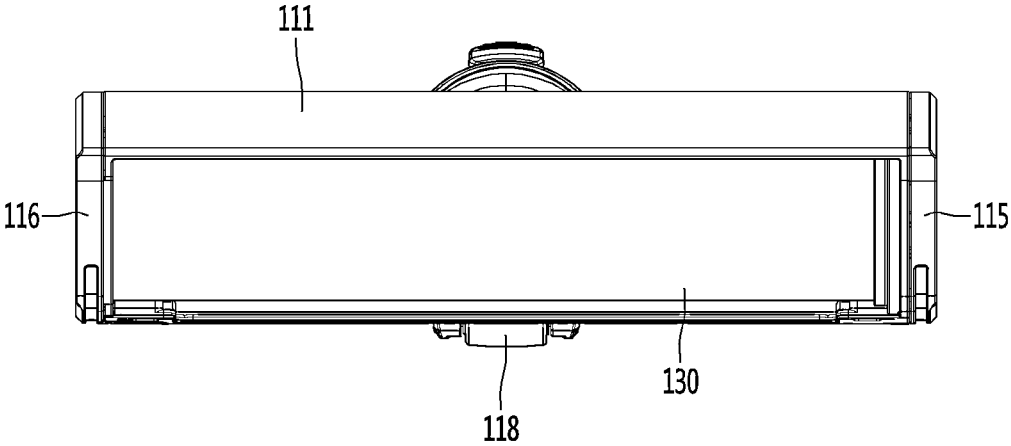
FIG. 5 is a front view of the suction nozzle of FIG. 1.
Figure 6:
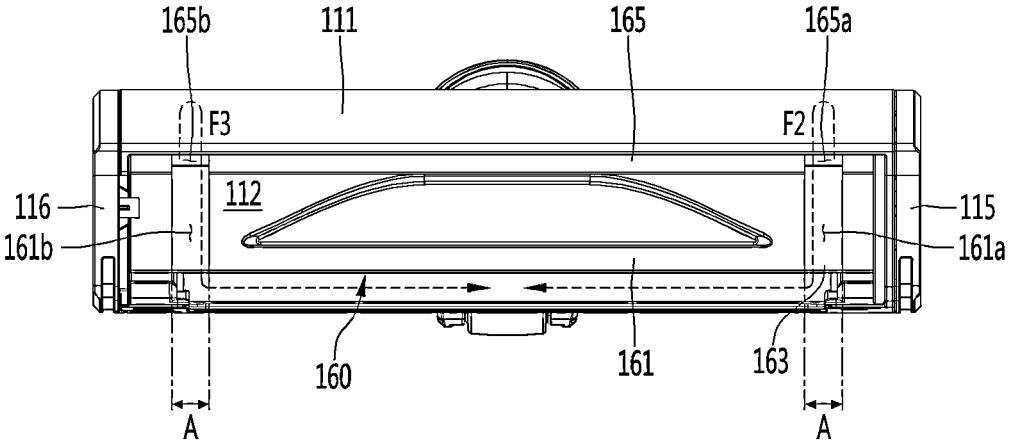
FIG. 6 is a view illustrating a state in which a rotation cleaning part is separated from the suction nozzle of FIG. 5.
Figure 7:
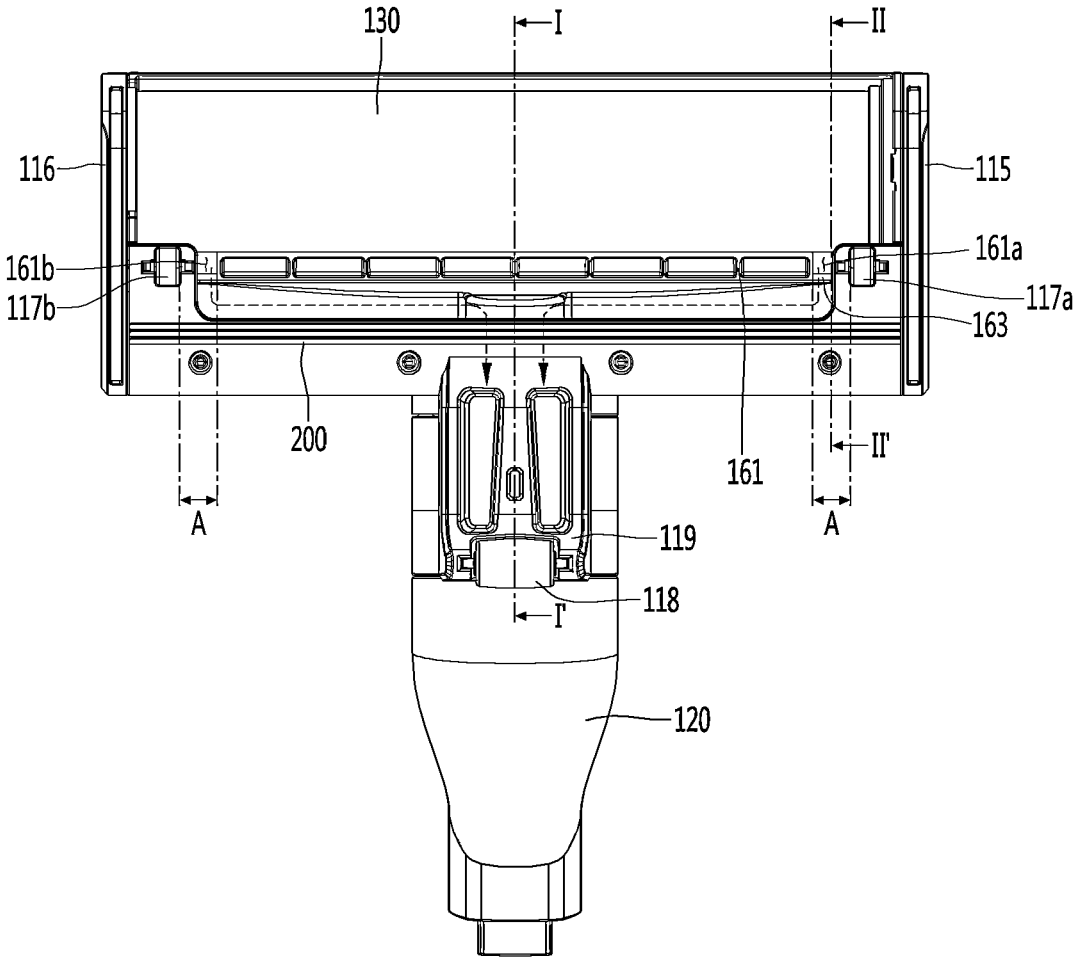
FIG. 7 is a bottom view of the suction nozzle of FIG. 1.
Figure 8:
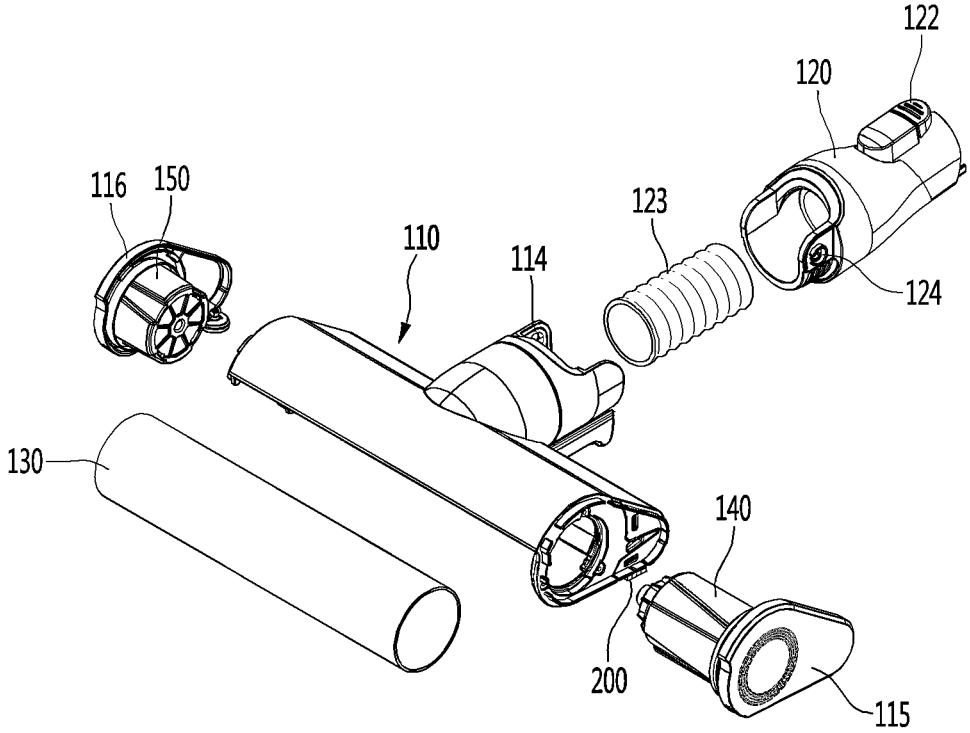
FIG. 8 is an exploded perspective view of the suction nozzle of FIG. 1.
Figure 9:
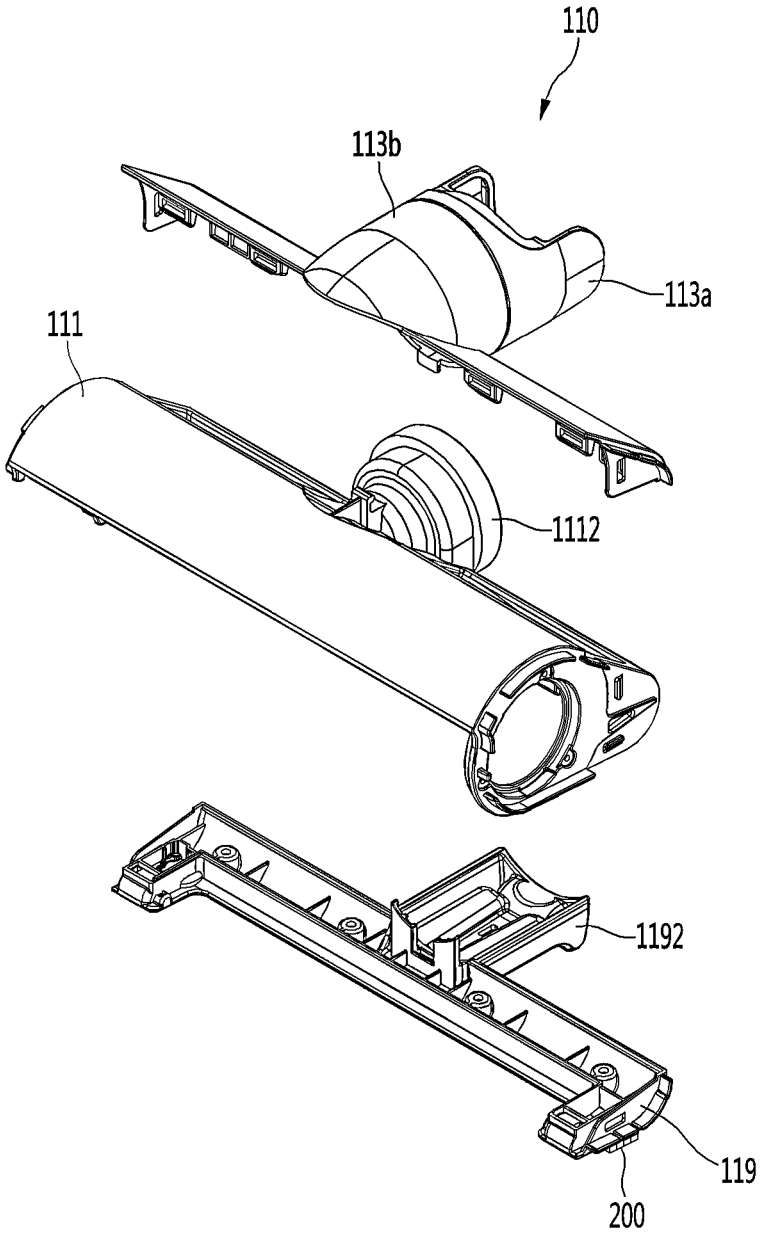
FIG. 9 is an exploded perspective view of a housing.
Figure 10:
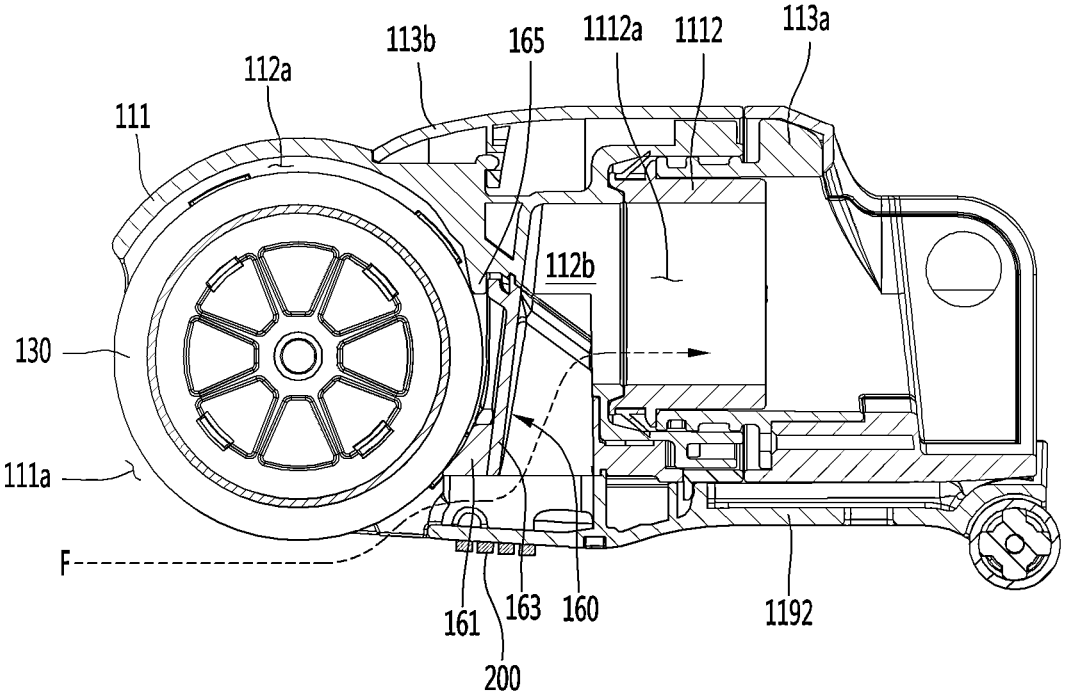
FIG. 10 is a cross-sectional view of the suction nozzle, taken along line I-I' of FIG. 7.
Figure 11:
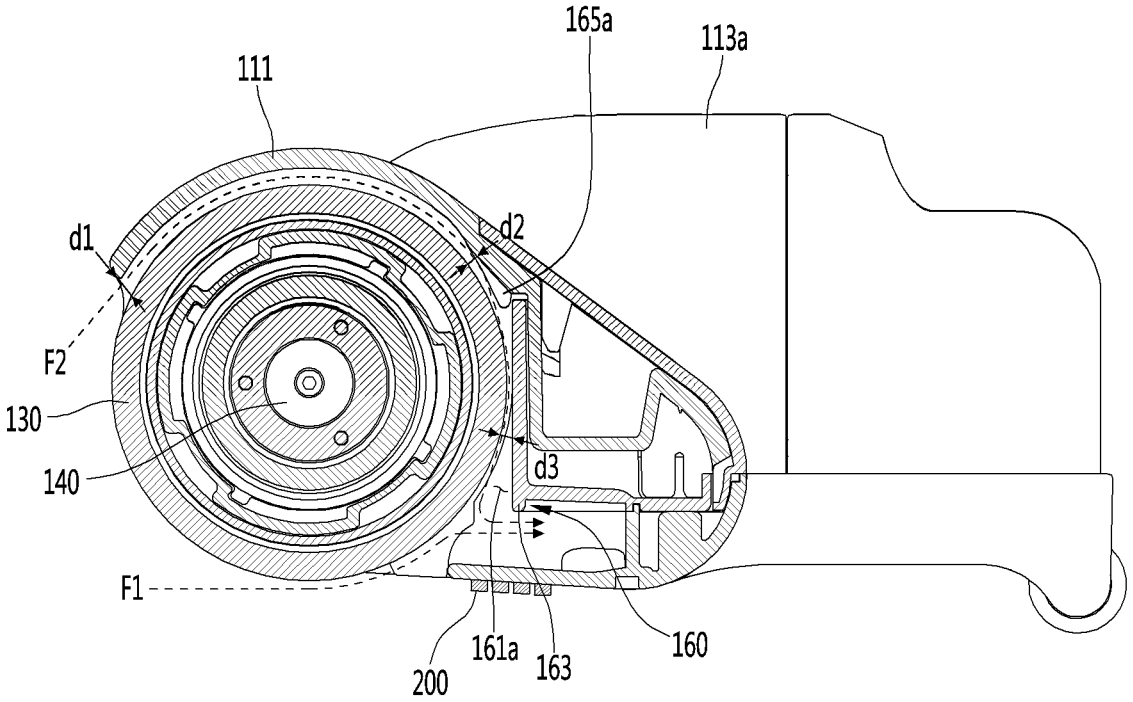
FIG. 11 is a cross-sectional view taken along line II-II' of FIG. 7.

FIG. 2 is a perspective view of the suction nozzle of FIG. 1, FIG. 3 is a plan view of the suction nozzle of FIG. 2, FIG. 4 is a side view of the suction nozzle of FIG. 1, FIG. 5 is a front view of the suction nozzle of FIG. 1, FIG. 6 is a view illustrating a state in which a rotation cleaning part is separated from the suction nozzle of FIG. 5, FIG. 7 is a bottom view of the suction nozzle of FIG. 1, FIG. 8 is an exploded perspective view of the suction nozzle of FIG. 1, FIG. 9 is an exploded perspective view of a housing, FIG. 10 is a cross-sectional view of the suction nozzle, taken along line I-I' of FIG. 7, and FIG. 11 is a cross-sectional view taken along line II-II' of FIG. 7.

Referring to FIGS. 2 to 11, the suction nozzle 100 includes a housing 110, a connection tube 120, and a rotation cleaning part 130.

Also, the suction nozzle 100 may include a sealing part 200 for sealing a rear side of the suction nozzle 100 on a bottom thereof.

The sealing part 200 is provided to block a flow of air flowing forward from the rear side when the suction force is generated in the suction nozzle 100.

The sealing part 200 may have an unevenness on the bottom surface that contacts the floor surface.

The sealing part 200 may extend in a left-right direction if it is assumed that the suction nozzle 100 moves in a front-rear direction.

Also, the unevenness provided on the bottom surface of the sealing part 200 may be alternately disposed in a direction that is parallel to the front-rear direction in which the suction nozzle 100 moves, and in a flow direction of the air suctioned into the suction nozzle 100.

Due to the configuration of the above-described sealing part 200, when the suction force is generated in the suction nozzle 100, if the flow of the air flowing forward from the rear side may be blocked or interrupted, the suction force suctioned forward from the rear side may increase to improve cleaning performance.

Description of the sealing part 200 will be described later with reference to FIGS. 12 to 28.

The housing 110 includes a body part 111 in which a chamber 112 is provided therein. A front opening 111*a* for suctioning air containing contaminants may be defined in the body part 111. The air introduced through the front opening 111*a* by the suction force generated in the cleaner body 10 may flow to the connection tube 120 via the chamber 112.

The front opening 111*a* may extend in a left-right direction of the housing 110, i.e., extend up to a front portion of the housing 110 as well as a bottom surface of the housing 110. Accordingly, since a suction area is secured sufficiently, cleaning may be uniformly performed from the floor surface to a portion adjacent to a wall surface.

The housing 110 may further include an inner tube 1112 communicating with the front opening 111*a*. Due to the suction force generated in the cleaner body 10, external air may flow to an inner passage 1112*a* of the inner tube 1112 via the front opening 111*a*.

The housing 110 may further include a driving part 140 that provides power for allowing the rotation cleaning part 130 to rotate. The driving part 140 may be inserted into one side of the rotation cleaning part 130 to transmit the power to the rotation cleaning part 130.

The rotation cleaning part 130 may be accommodated in the chamber 112 of the body part 111. At least a portion of the rotation cleaning part 130 may be exposed to the outside through the front opening 111*a*. The rotation cleaning part 130 may rotate by driving force transmitted through the driving part 140 to dust the contaminants by friction with the floor surface. Also, an outer circumferential surface of the rotation cleaning part 130 may be made of a fabric or felt material such as cotton flannel. Thus, when the rotation cleaning part 130 rotates, foreign substances such as dust accumulated on the floor surface may be caught in the outer circumferential surface of the rotation cleaning part 130 and thus be effectively removed.

The body part 111 may cover at least a portion of an upper side of the rotation cleaning part 130. Also, an inner circumferential surface of the body part 111 may have a curved shape to correspond to the outer circumferential surface of the rotation cleaning part 130. Accordingly, the body part 111 may perform a function of preventing the foreign substances, which is dusted from the floor surface of the rotation cleaning part 130, from ascending.

The housing 110 may further include side covers 115 and 116 covering both side surfaces of the chamber 112. The side covers 115 and 116 may be provided on both side surfaces of the rotation cleaning part 130.

The side covers 115 and 116 include a first side cover 115 provided at one side of the rotation cleaning part 130 and a second side cover 116 provided at the other side of the rotation cleaning part 130. The driving part 140 may be fixed to the first side cover 115.

The suction nozzle 100 further includes a rotation support part 150 provided on the second side cover 116 to rotatably support the rotation cleaning part 130. The rotation support part 150 may be inserted into the other side of the rotation cleaning part 130 to rotatably support the rotation cleaning part 130.

The rotation cleaning part 130 may rotate in a counterclockwise direction with respect to the cross-sectional view of FIG. 10. That is, the rotation cleaning part 130 rotates to be pushed from a contact point with the floor surface toward the inner tube 1112. Therefore, the foreign substances dusted from the floor surface of the rotation cleaning part 130 are move toward the inner tube 1112 and then suctioned into the inner tube 1112 by the suction force. The rotation cleaning part 130 may rotate backward with respect to the contact point with the floor surface to improve cleaning efficiency.

A partition member 160 may be provided in the chamber 112. The partition member 160 may extend downward from an upper side of the chamber of the housing 110.

The partition member 160 may be provided between the rotation cleaning part 130 and the inner tube 1112. Accordingly, the partition member 160 may partition the chamber of the housing 110 into a first region 112*a*, in which the rotation cleaning part 130 is disposed, and a second region 112*b*, in which the inner tube 1112 is disposed. As illustrated in FIG. 10, the first region 112*a* may be provided in the front of the chamber 112, and the second region 112*b* may be provided in the rear of the chamber 112.

The partition member 160 may include a first extension wall 161. The first extension wall 161 may extend so that at least a portion thereof contacts the rotation cleaning part 130. Thus, when the rotation cleaning part 130 rotates, the first extension wall 161 may dust the foreign substances attached to the rotation cleaning part 130 through the friction with the rotation cleaning part 130.

Also, the first extension wall 161 may extend along a rotation axis of the rotation cleaning part 130. That is, a contact point between the first extension wall 161 and the rotation cleaning part 130 may be defined along a direction of the rotation axis of the rotation cleaning part 130. Accordingly, the first extension wall 161 may not only dust the foreign substances attached to the rotation cleaning part 130, but also block the introduction of the foreign substances on the floor surface into the first region 112*a* of the chamber 112. Since the introduction of the foreign substances into the first region 112*a* of the chamber 112 is blocked, the foreign substances may be prevented from being discharged in the front of the housing 110 through the front opening 111*a* by the rotation of the rotation cleaning part 130.

In addition, the first extension wall 161 may block introduction of hair or yarn attached to the rotation cleaning part 130 into the first region 112*a* of the chamber 112 to prevent the hair or yarn from being tangled with the rotation cleaning part 130. That is, the first extension wall 161 may perform an anti-tangle function.

The partition member 160 may further include a second extension wall 165. Like the first extension wall 161, the second extension wall 165 may extend to at least partially contact the rotation cleaning part 130. Thus, when the rotation cleaning part 130 rotates, the second extension wall 165 may dust the foreign substances attached to the rotation cleaning part 130 through the friction with the rotation cleaning part 130, like the first extension wall 161. The second extension wall 165 has the same function as the first extension wall 161. As a result, since the foreign substances attached to the rotation cleaning part 130 are dusted using only the first extension wall 161 without the second extension wall 165, the second extension wall 165 may not be included in the configuration of the housing 110.

The second extension wall 165 may be disposed above the first extension wall 161. Thus, the second extension wall 165 has a function of secondary separation of the foreign substances, which are not separated by the first extension wall 161, in the rotation cleaning part 130.

Hereinafter, a flow of air in the housing 110 will be described.

A plurality of suction passages F1, F2, and F3 through which external air flows to the inner tube of the body part 111 are provided in the body part 111 of the suction nozzle 100.

The plurality of suction passages F1, F2, and F3 include a lower passage F1 provided below the rotation cleaning part 130 and upper passages F2 and F3 provided above the rotation cleaning part 130.

The lower passage F1 is provided below the rotation cleaning part 130. Particularly, the lower passage F1 is connected to the inner passage 1112*a* from the front opening 111*a* via a lower side of the rotation cleaning part 130 and the second area 112*b*.

The upper passages F2 and F3 are provided above the rotation cleaning part 130. In detail, the upper passages F2 and F3 may be connected to the inner passage 1112*a* via an upper side of the rotation cleaning part 130 and the second area 112*b* in the first area 112*a*. Accordingly, the upper passages F2 and F3 may be combined with the lower passage F1 in the second region 112*b*.

The upper passages F2 and F3 include a first upper passage F2 provided at one side of the housing 110 and a second upper passage F3 provided at the other side of the housing 110. In detail, the first upper passage F2 is disposed adjacent to the first side cover 115, and the second upper passage F3 is disposed adjacent to the second side cover 116.

To provide the first upper passage F2, a first lower groove 161*a* may be defined in the first extension wall 161, and a first upper groove 165*a* may be defined in the second extension wall 165.

The first lower groove 161*a* is defined by recessing a portion of the inner circumferential surface of the first extension wall 161, that is, a portion of a surface contacting the rotation cleaning part 130. Also, the first lower groove 161*a* may extend along a circumferential direction of the rotation cleaning part 130.

The first upper groove 165*a* is defined by recessing a portion of the inner circumferential surface of the second extension wall 165, that is, a portion of a surface contacting the rotation cleaning part 130. Also, the first upper groove 165*a* may extend along the circumferential direction of the rotation cleaning part 130.

The first lower groove 161*a* is connected to the first upper groove 165*a*, and the first upper passage F2 is provided along the first lower groove 161*a* and the first upper groove 165*a*. When the second extension wall 165 is not provided in the suction nozzle 100, the first upper passage F2 may be provided only by the first lower groove 161*a*.

Also, the first lower groove 161*a* and the first upper groove 165*a* may be defined to surround the driving part 140. Thus, the first upper passage F2 may be provided to surround at least a portion of the driving part 140 along a circumference of the driving part 140, and the driving part 140 may be cooled by air flowing along the first upper passage F2.

The first lower groove 161*a* and the first upper groove 165*a* may have the same left-right width A as illustrated in the drawings, but is not limited thereto. The left-right width A of each of the first lower groove 161*a* and the first upper groove 165*a* may have a predetermined size. When the left-right width A is small, a width of the first upper passage F2 is narrowed, and thus cooling performance of the driving part 140 may be insignificant because a flow rate of air is small, or a flow of air may be blocked. On the other hand, when the left-right width A is large, the flow rate of the air may increase because the width of the first upper passage F2 increases, but the anti-tangle function for preventing the hair or the like from being tangled with the rotation cleaning part may be deteriorated. Thus, the left-right width A has to be provided to an appropriate size and may be provided to have a width less than a length of the driving part. For example, the left-right width A of the first upper groove 165*a* may be about 5 mm to about 10 mm, but is not limited thereto.

As illustrated in FIG. 11, a spaced distance between the inner circumferential surface of the chamber 112 and the upper portion of the rotation cleaning part 130 in the first upper passage F2 may decrease toward the inside of the chamber 112. Particularly, the spaced distance between the inner circumferential surface of the chamber 112 and the upper portion of the rotation cleaning part 130 is defined as d1 at the front opening 165*a*, d2 at the first upper groove 165*a*, and d3 at the first lower groove 161*a*. The spaced distances gradually decrease from d1 to d3 (d1>d2>d3). For example, d1 may be about 3 mm, d2 may be about 2.7 mm, and d3 may be about 2 mm. Due to the above-described feature, an air velocity of the air may be reduced at the upper side of the rotation cleaning part 130 as being closer to the front opening 111*a*. Thus, the discharge of the foreign substances to the front side by the rotation of the rotation cleaning part 130 may be suppressed.

Next, the second upper passage F3 will be described. To provide the second upper passage F3, a second lower groove 161*b* is defined in the first extension wall 161, and a second upper groove 165*b* is defined in the second extension wall 165.

The second lower groove 161*b* is defined at a position adjacent to the second side cover 116 in the inner circumferential surface of the first extension wall 161, that is, a surface in contact with the rotation cleaning part 130. The second lower groove 161*b* is different from the first lower groove 161*a* in formation position, and the remaining components are substantially the same.

The second upper groove 165*b* is formed at a position adjacent to the second side cover 116 on an inner circumferential surface of the second extension wall 165, that is, a surface in contact with the rotation cleaning part 130. The second upper groove 165*b* is connected to the second lower groove 161*b*, and the second upper passage F3 is provided along the second lower groove 161*b* and the second upper groove 165*b*. When the second extension wall 165 is not provided in the suction nozzle 100, the second upper passage F3 may be provided only by the second lower groove 161*b*.

Also, the second lower groove 161*b* and the second upper groove 165*b* may be defined to surround the rotation support portion 150. Thus, the second upper passage F3 may be provided along the circumference of the rotation support part 150, and the rotation support part 150 is cooled by air flowing along the second upper passage F3.

The second lower groove 161*b* and the second upper groove 165*b* may have the same left-right width A as illustrated in the drawings, but is not limited thereto. Each of the left-right width A of the second lower groove 161*b* and the left-right width A of the second upper groove 165*b* may be the same as the left-right width A of each of the first lower groove 161*a* and the first upper groove 165*a*.

A spaced distance between the inner circumferential surface of the chamber 112 and the upper portion of the rotation cleaning part 130 in the second upper passage F3 may gradually decrease toward the inside of the chamber 112, like the first upper passage F2. Thus, detailed descriptions thereof will be omitted.

The partition member 160 may further include a third extension wall 163 coupled to the first extension wall 161. The third extension wall 163 may be coupled to a rear surface of the first extension wall 161 to support the first extension wall 161. Since the first lower groove 161*a* and the second lower groove 161*b* are defined in the first extension wall 161, a portion of the third extension wall 163 may be exposed to the first region 112*a* of the chamber 112.

As described above, the first upper passage F2 provided above the rotation cleaning part 130 as well as the lower passage F1 provided below the rotation cleaning part 130 may be provided in the housing 110 to efficiently cool the driving part 140. Also, the second upper passage F3 may be provided to efficiently cool the rotation support part 150.

The connection tube 120 may connect the housing 110 and the extension tube 17 (see FIG. 1). That is, one side of the connection tube 120 is connected to the housing 110, the other side of the connection tube 120 is connected to the extension tube 17.

A detachable button 122 for manipulating the mechanical coupling with the extension tube 17 may be provided on the connection tube 120. The user may manipulate the detachable button 122 to couple the connection tube 120 to the extension tube 17.

The connection tube 120 may be rotatably connected to the housing 110. In detail, the connection tube 120 may be hinge-coupled to the first connection member 113*a* so as to be rotatable in the vertical direction.

Connection members 113*a* and 113*b* that is hinge-coupled to the connection tube 120 may be provided on the housing 110. The connection members 113*a* and 113*b* may be provided to surround the inner tube 1112. The connection members 113*a* and 113*b* may include a first connection member 113*a* and a second connection member 113*b*, which are directly connected to the connection tube 120. One side of the second connection member 113*b* may be coupled to the first connection member 113*a*, and the other side of the second connection member 113*b* may be coupled to the body part 111.

As illustrated in FIG. 8, the first connection member 113*a* may include a hinge hole 114, and the connection tube 120 may include a hinge shaft 124 inserted into the hinge hole 114. However, unlike shown in the drawings, the hinge hole may be defined in the connection tube 120, and the hinge shaft may be provided in the first connection member 113*a*. The hinge hole 114 and the hinge shaft 124 may be collectively referred to as a "hinge part".

A center 124*a* of the hinge shaft 124 may be disposed above a central axis C of the first connection member 113*a*. Accordingly, a rotation center of the connection tube 120 may be defined above the central axis C of the first connection member 113*a*.

The first connection member 113*a* may be rotatably connected to the second connection member 113*b*. Particularly, the first connection member 113*a* may rotate with respect to an axis in the longitudinal direction.

The suction nozzle 100 may further include an auxiliary hose 123 connecting the connection tube 120 to the inner tube 1112 of the housing 110. Thus, the air suctioned into the housing 110 may move to the cleaner body 10 (see FIG. 1) via the auxiliary hose 123, the connection tube 120, and the extension tube 17 (see FIG. 1) to the cleaner body 10 (see FIG. 1).

The auxiliary hose 123 may be made of a flexible material so that the connection tube 120 is rotatable. Also, the first connection member 113*a* may have a shape surrounding at least a portion of the auxiliary hose 123 to protect the auxiliary hose 123.

The suction nozzle 100 may further include front wheels 117*a* and 117*b* for movement during the cleaning. The front wheels 117*a* and 117*b* may be rotatably provided on the bottom surface of the housing 110. Also, the front wheels 117*a* and 117*b* may be provided in pairs. The pair of front wheels 117 and 117*b* may be respectively provided on both sides of the front opening 111*a* and may be disposed behind the front opening 111*a*.

The suction nozzle 100 may further include a rear wheel 118. The rear wheel 118 is rotatably provided on the bottom surface of the housing 110 and may be disposed behind the front wheels 117*a* and 117*b*.

The housing 110 may further include a support member 119 provided below the body part 111. The support member 119 may support the body part 111. The front wheels 117*a* and 117*b* may be rotatably coupled to the support member 119.

An extension portion 1192 extending backward may be provided on the support member 119. The rear wheels 118 may be rotatably coupled to the extension portion 1192. Also, the extension portion 1119 may support the first connection member 113*a* and the second connection member 113*b* at the lower side.

The rotation shaft 118*a* of the rear wheel 118 may be disposed behind the center 124*a* of the hinge shaft 124. Thus, since the housing 110 is improved in stability, overturning of the housing 110 may be prevented from occurring during the cleaning.

Figure 12:
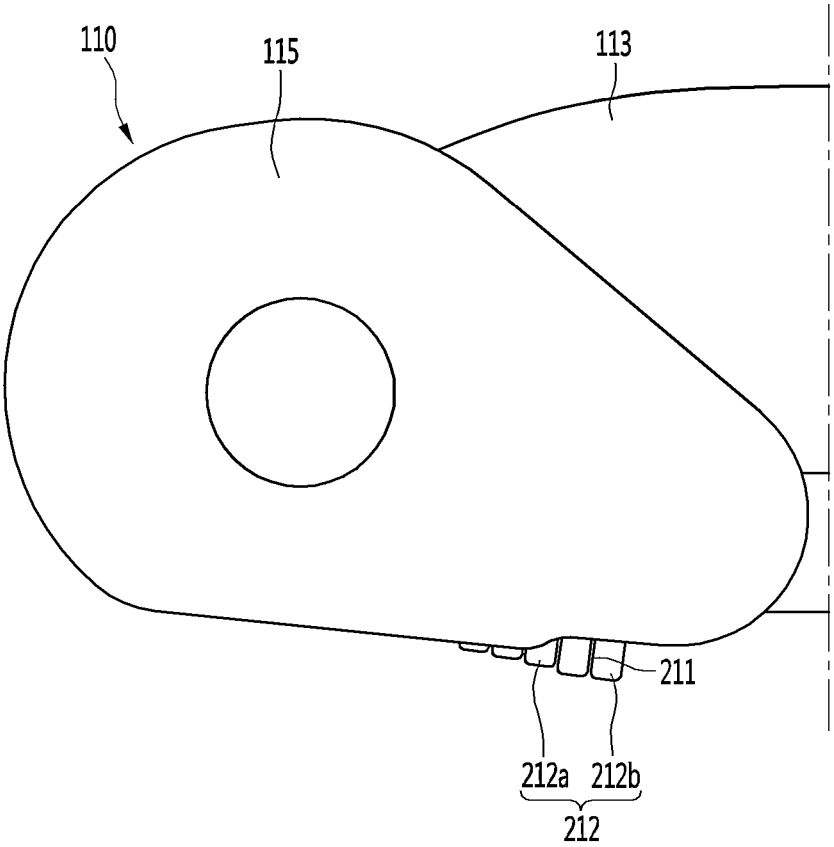
FIG. 12 is a view illustrating a suction nozzle of a vacuum cleaner when viewed from one side according to another embodiment of the present invention.
Figure 13:
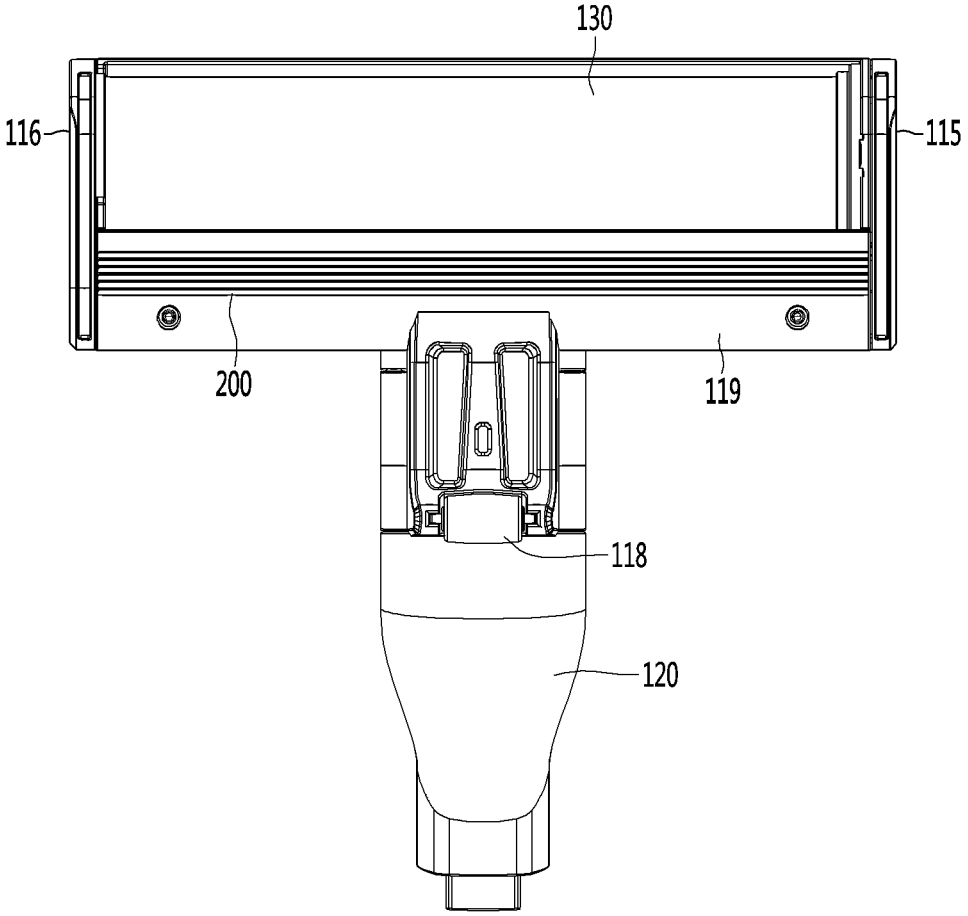
FIG. 13 is a bottom surface of the suction nozzle of FIG. 12.

FIG. 12 is a view illustrating a suction nozzle of a vacuum cleaner when viewed from one side according to another embodiment of the present invention. FIG. 13 is a bottom surface of the suction nozzle of FIG. 12.

Referring to FIGS. 12 and 13, the suction nozzle 100 includes a sealing part 200 in the rear of the front opening 111*a* on a bottom surface thereof.

The sealing part 200 protrudes downward from a lower end of the housing 110 and is provided to be spaced apart from the rear of the front opening 111*a*.

When the floor surface is cleaned using the vacuum cleaner, dust on the floor surface may be suctioned while the suction nozzle 100 moves by a user.

Here, the suction nozzle 100 has to be in contact with the floor surface except for a front opening 111*a* into which the dust is suctioned so as to perform suction performance.

According to an embodiment, to improve the dust suction performance, when the suction operation is performed, a sealing part 200 that is in contact with the floor surface, is provided.

The sealing part 200 is in close contact with the floor surface by a differential pressure during the suction operation of the suction nozzle 100. Then, when the sealing part 200 is in close contact with the floor surface, introduction of air from a rear side may be prevented. Also, dust suction force through the front opening 111*a* may increase.

Referring again to FIGS. 12 to 13, a sealing groove 211 that is recessed upward from a lower end and extends in a longitudinal direction of the suction nozzle 100 may be defined in the sealing part 200.

For another example, the sealing groove 211 may be provided in the form of a slit that is defined by vertically cutting the sealing part 200.

Also, the sealing groove 211 may be provided in plurality, which are spaced apart from each other in a front-rear direction.

Here, the front-rear direction (with respect to a vertical direction in FIG. 13) may mean a direction in which air is suctioned.

As described above, when the plurality of sealing grooves 211 are defined in the bottom surface of the sealing part 200, a sealing protrusion 212 may be provided between the sealing grooves 211.

The sealing protrusion 212 has a shape that is convex downward.

Each of the sealing groove 211 or the sealing protrusion 212 may have a rectangular shape when viewed from one side. Also, an edge portion of each of the sealing groove 211 or the sealing protrusion 212 may be curved.

Also, an inclined surface may be disposed on a portion of each of the sealing groove 211 or the sealing protrusion 212.

The sealing groove 211 and the sealing protrusion 212 may extend in a longitudinal direction of the suction nozzle 100 (a left-right direction in FIG. 13).

The front opening 111*a* and the sealing part 200 extend in the left and right directions of the housing 110.

Also, the sealing part 200, i.e., the sealing groove 211 and the sealing protrusion 212 may extend in a direction crossing an air inflow direction.

Also, the plurality of sealing grooves 211 and sealing protrusions 212 may be alternately provided in a direction parallel to the air inflow direction.

Also, the sealing part 200 may be made of a material having elasticity or flexibility. For example, the sealing part 200 may be made of rubber or silicon.

Also, in the suction nozzle 100, the connection tube 120 connected to the cleaner body 10 may be disposed in the rear of the housing 110, and the sealing part 200 may be disposed between the front opening 111*a* and the connection tube 120.

Also, the housing 110 may include a body part 111 in which the front opening 111*a* is defined at a front side, and a chamber 112 communicating with the front opening 111*a* is provided therein and which covers an upper side of the rotation cleaning part 130 and a support member 119 provided below the body part 111.

Also, the sealing part 200 may be provided on a bottom surface of the support member 119.

Here, a front end of the body part 111 and a front end of the support member 119 may be spaced apart from each other to define the front opening 111*a*.

Referring again to FIG. 12, in the sealing protrusion 212, a sealing protrusion 212*b* disposed at a rear side may further protrude than a sealing protrusion 212*a* disposed at a front side.

As described above, when the sealing part 200 in which the sealing groove 211 and the sealing protrusion 212 are alternately disposed is provided at the rear of the front opening 111*a*, the flow of the air forward from the rear side may be blocked during the operation of the vacuum cleaner.

In detail, when an unevenness is provided by the sealing groove 211 and the sealing protrusion 212 on a bottom surface of the sealing part 200, a pressure difference between the sealing groove 211 and the sealing protrusion 212 is generated. Also, due to the pressure difference, flow resistance occurs, and as a result, the flow of the air flowing forward from the rear side may be disturbed. Also, suction force in the front side may increase to improve cleaning performance.

Also, the sealing part 200 may be provided on both sides of the front opening 111*a* as well as the rear of the front opening 111*a*.

That is, the sealing part 200 may be provided at various positions except for the front of the front opening 111*a*.

Also, when the sealing member 200 is viewed from the bottom, the sealing member 200 may be provided in a straight line shape or a curved shape. Also, the sealing member 200 may be provided in a bent form.

Also, the sealing member 200 may be provided from one end to the other end of the housing 110 or may be provided only in a partial section of the housing 110.

Also, the sealing member 200 may be provided in plurality, which are spaced apart from each other.

Also, a second sealing part made of a cushion material may be additionally provided between the sealing member 200 and the front opening 111*a* while contacting the floor surface, thereby removing dust and preventing a flow of air flowing forward from the rear side.

Figure 14:
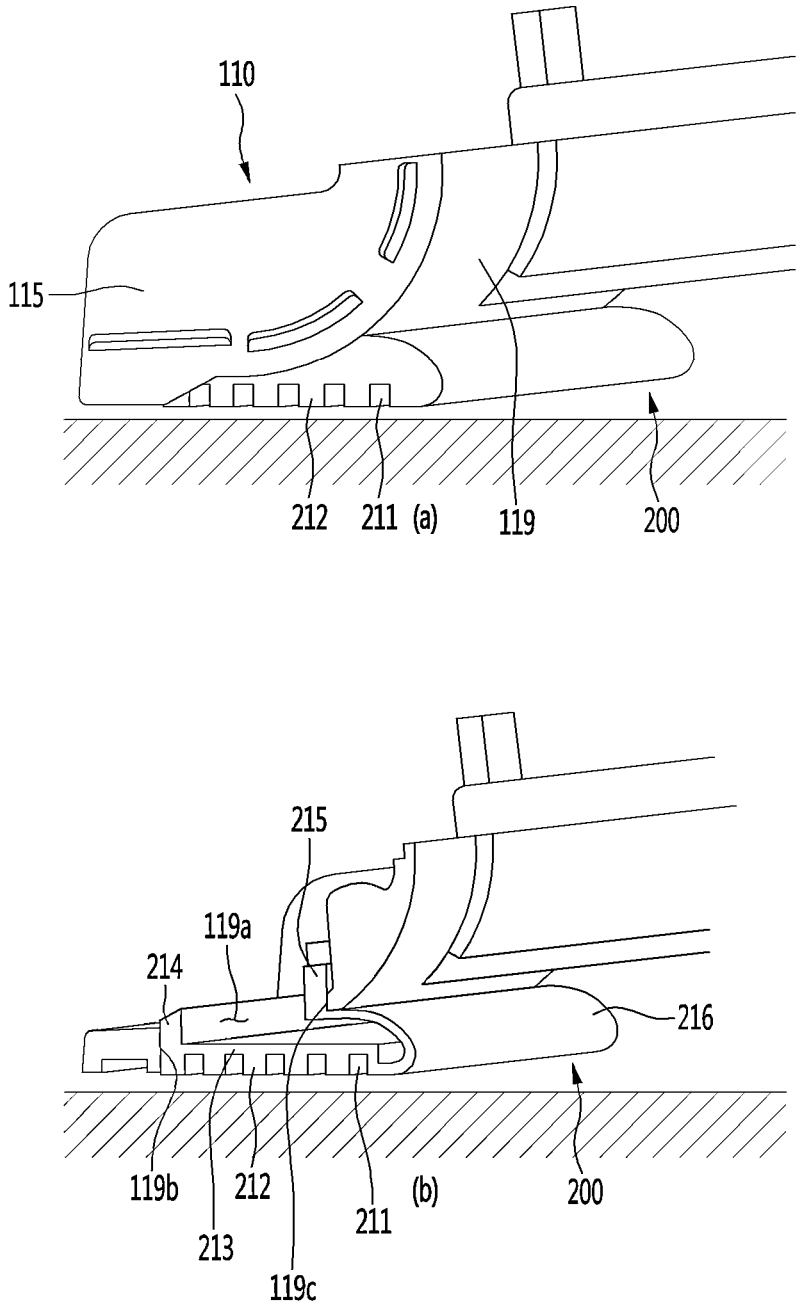
FIGS. 14 and 15 are partial cross-sectional views illustrating a sealing part and a housing of the vacuum cleaner according to another embodiment.
Figure 15:
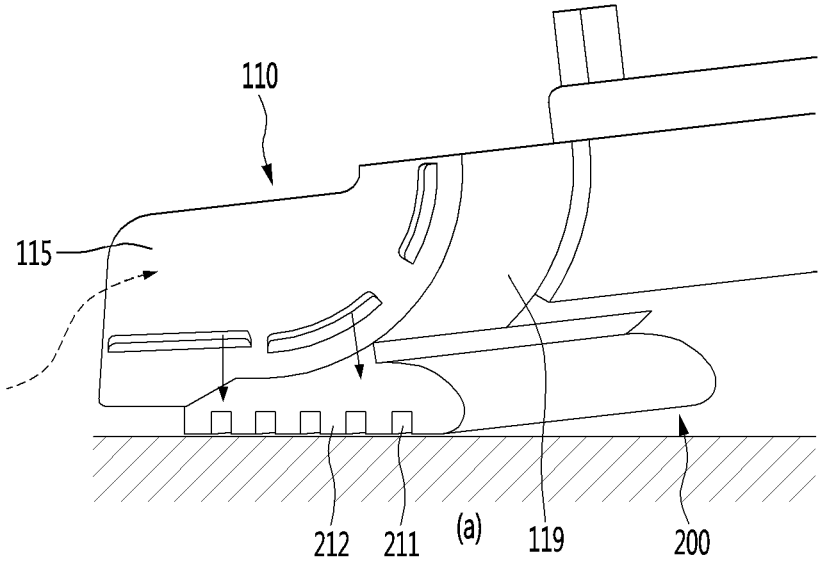
Figure 15:
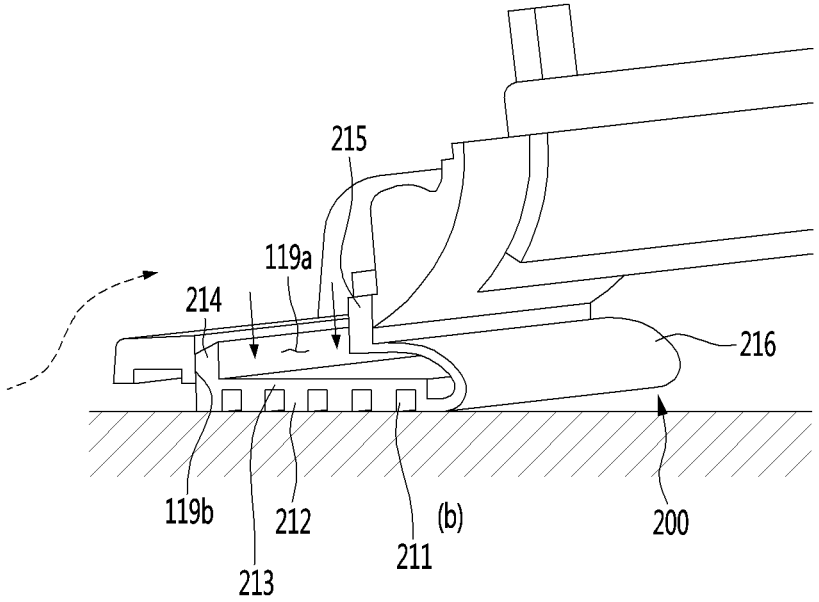

FIGS. 14 and 15 are partial cross-sectional views illustrating the sealing part and the housing of the vacuum cleaner according to another embodiment.

In detail, FIG. 14 is a view illustrating a state of the sealing part before the suction force is generated in the suction nozzle, and FIG. 15 is a view illustrating a state of the sealing part after the suction force is generated in the suction nozzle.

Referring to FIGS. 14 and 15, the sealing part 200 may be connected to a rear portion of the suction nozzle 100 so as to be elevatable.

Here, the elevation operation may mean a case of being elevated vertically in a straight line. Also, the elevation operation may mean all cases of moving vertically while at least a portion of the of the sealing part 200 moves along a straight or curved trajectory. Also, the elevation operation may also mean a case in which at least a portion of the sealing part 200 moves vertically while rotating.

In this embodiment, the sealing part 200 may be made of an elastic material. For example, the sealing part 200 may be made of a rubber or silicon material.

Referring to FIGS. 14 to 15, when the suction force is generated in the suction nozzle 100, the sealing part 200 contacts the floor surface while descending by the difference pressure.

Also, when the sealing part 200 descends as described above, a lower end of the sealing part 200 is disposed lower than a lower end of the front opening 111*a*.

Referring to FIGS. 14 to 15, at least a portion of the rear portion of the housing 110 may be opened to define a rear opening 119.

The housing 110 includes a first side surface 119*b* defining the rear opening 119 and a second side surface 119*c* spaced backward from the first side surface 119*b* to face the first side surface 119*b*.

Also, the sealing part 200 may include a second extension portion 214 and a first extension portion 215, which respectively contact the first side surface 119*b* and the second side surface 119*c* to extend upward.

The sealing part 200 may be elevated in a state in which the first extension portion 215 and the second extension portion 214 respectively contact the first side surface 119*b* and the second side surface 119*c*.

Also, the sealing part 200 may further include a third extension portion 216 extending backward from a lower end of the second extension portion 214.

The third extension portion 216 may have a curved surface that is convex upward or backward.

Due to the configuration of the third extension portion 216, a longitudinal length of a sealing pad 213 that will be described later may increase. That is, due to the configuration of the third extension portion 216, the longitudinal length of the sealing pad 213 that will be described later may be greater than a distance between the first extension portion 215 and the second extension portion 214. Also, a flow of air flowing forward from the rear side may be more surely blocked.

The sealing part 200 includes the sealing pad 213 connecting a lower end of the third extension portion 216 to a lower end of the second extension portion 214, and a sealing groove 211 that is recessed upward from a lower end thereof and parallel to a longitudinal direction of the suction nozzle 100 may be defined in the sealing pad 213.

The sealing groove 211 and the sealing protrusion 212 extend in a direction crossing the air inflow direction (a left-right direction in FIG. 14).

Also, the plurality of sealing grooves 211 and sealing protrusions 212 may be provided alternately in a direction parallel to the air inflow direction (the left-right direction in FIG. 14).

Referring to FIG. 14, in the suction nozzle 100, before the suction force is generated, the sealing part 200 may be in an elevated state and be spaced apart from the floor surface.

On the other hand, referring to FIG. 15, in the suction nozzle 100, when the suction force occurs, the sealing part 200 may descend to contact the floor surface.

Also, when air is introduced forward from the rear side through a space between the floor surface and the bottom surface of the sealing pad 213, a sudden decrease in flow resistance and a sudden increase in flow resistance alternately occur by the sealing protrusions 212 and the sealing grooves 211, which are alternately disposed. Also, in each of the sealing grooves 211, an eddy current may be generated, and a differential pressure may be generated by multiple flow resistance, and as a result, a bottom surface pressure may increase while external air inflow resistance increase.

Then, a flow rate of air flowing forward from the rear side may be sharply reduced, and the front suction force through the front opening 111*a* may increase to improve cleaning performance.

For reference, (a) of FIG. 14 is a perspective view illustrating a state of the sealing part before the suction force is generated in the suction nozzle, and (b) of FIG. 14 is a partial cutaway perspective view illustrating a state of the sealing part before the suction force is generated in the suction nozzle.

Also, (a) of FIG. 15 is a perspective view illustrating a state of the sealing part after the suction force is generated in the suction nozzle, and (b) of FIG. 15 is a partial cutaway perspective view illustrating a state of the sealing part after the suction force is generated in the suction nozzle.

Figure 16:
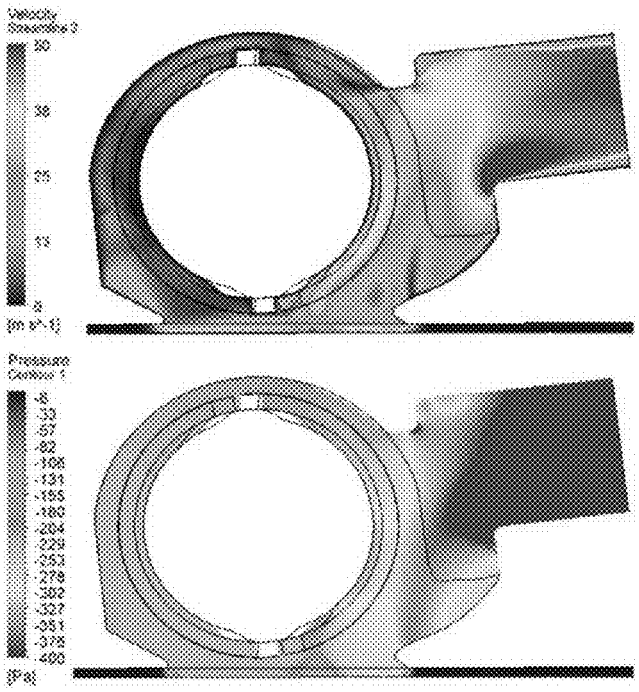
FIG. 16 is a view obtained by comparing flow analysis results of the suction nozzle depending on whether the sealing part is provided.
Figure 16:
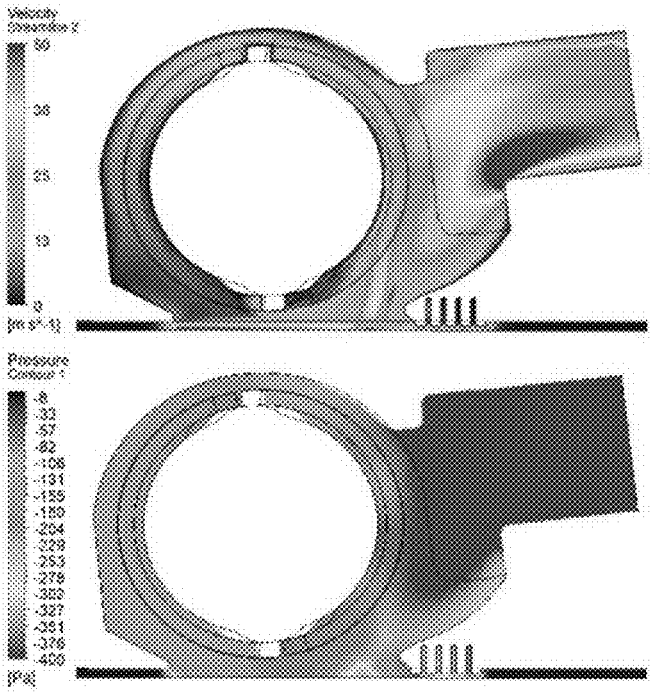

FIG. 16 is a view obtained by comparing flow analysis results of the suction nozzle depending on whether the sealing part is provided.

First, (a) of FIG. 16 is a diagram illustrating flow velocity distribution and pressure distribution analysis result of the suction nozzle in which the sealing part is not installed, and (b) of FIG. 16 is a diagram illustrating flow velocity distribution and pressure distribution analysis result of the suction nozzle in which the sealing part is installed.

Referring to (a) of FIG. 16, when the sealing part 200 is not provided, a suction flow velocity and a suction pressure are deflected to the rear side to decrease in front suction force. As a result, it may be confirmed that the suction performance of the foreign substances at the front opening 111*a* is deteriorated.

On the other hand, referring to (b) of FIG. 16, when the sealing part 200 is not provided, a suction flow velocity and a suction pressure are deflected to the front side to increase in front suction force. As a result, it may be confirmed that the suction performance of the foreign substances at the front opening 111*a* is improved.

Figure 17:
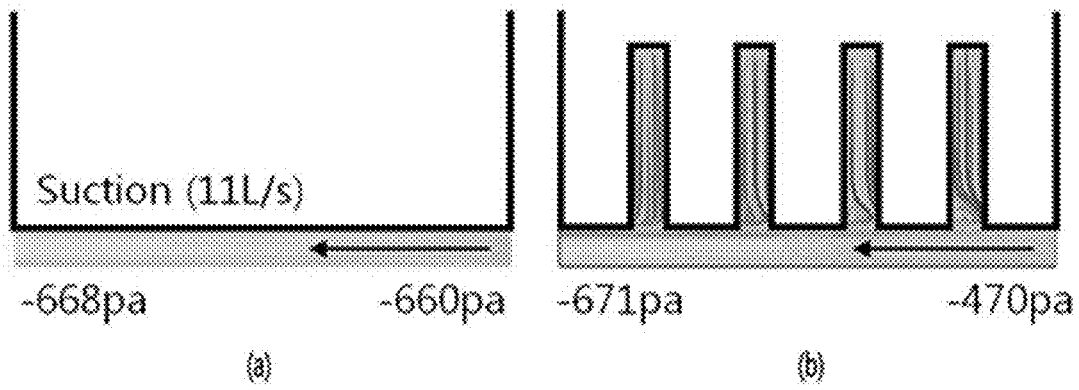
FIG. 17 is a view obtained by comparing flow analysis results of the suction nozzle depending on whether the sealing part is provided.

FIG. 17 is a view obtained by comparing flow analysis results of the suction nozzle depending on whether the sealing part is provided.

(a) of FIG. 17 illustrates results obtained by analyzing a pressure difference between the front side and the rear side of the sealing part in which the sealing groove is not provided, and (b) of FIG. 17 illustrates results obtained by analyzing a pressure difference between the front side and the rear side of the sealing part in which the sealing groove is provided.

First, in the case of (a) of FIG. 17, it may be confirmed that the pressure difference between the rear side and the front side of the sealing part hardly occurs.

On the other hand, in the case of (b) of FIG. 17, it may be confirmed that a pressure difference between the rear side (right side in FIG. 17) and the front side (left side in FIG. 17) occurs to about −200 Pa.

In the case of (b) of FIG. 17, it may be confirmed that the suction pressure of the rear side (right side in FIG. 17) of the sealing part is lower about 30% than that in the case of (a) of FIG. 17.

That is, as shown in (b) of FIG. 17, when the sealing part in which the sealing groove is defined is applied, it is understood that a suction negative pressure is reduced while passing through the sealing groove in multi-stages, and as a result, a flow of air flowing forward from the rear side is more reliably blocked.

Figure 18:
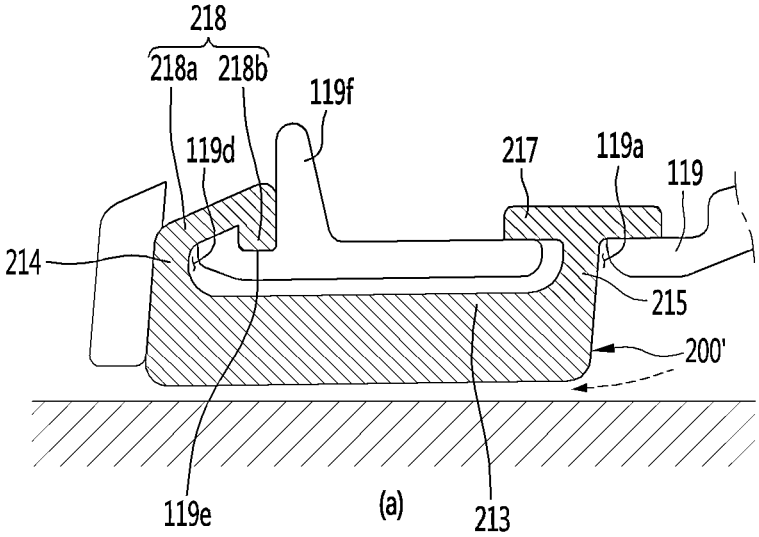
FIG. 18 is a partial cross-sectional view of a sealing part and a housing of a vacuum cleaner according to further another embodiment.
Figure 18:
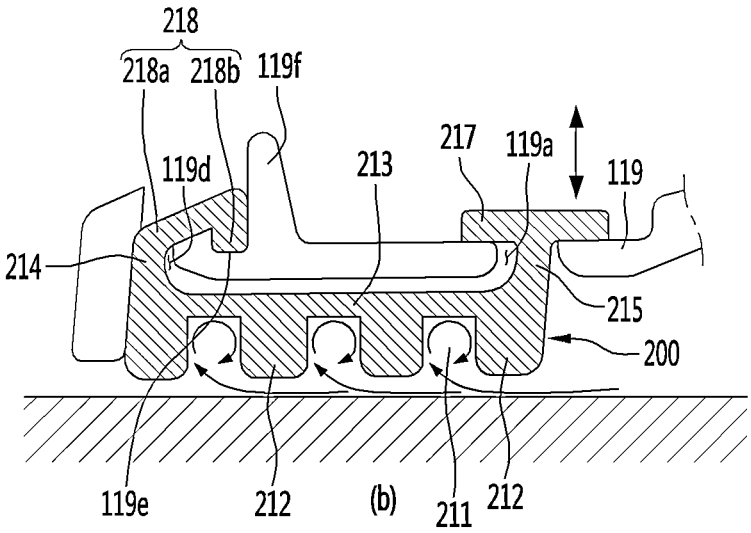

FIG. 18 is a partial cross-sectional view of a sealing part and a housing of a vacuum cleaner according to a further embodiment.

Referring to FIG. 18, at least a portion of the housing 110 may be opened to define rear openings 119*a* and 119*d*.

Here, the rear openings 119*a* and 119*d* may include a first rear opening 119*a* and a second rear opening 119*d*.

The first rear opening 119*a* and the second rear opening 119*d* may be spaced apart from each other in a front-rear direction (left-right direction in FIG. 18). The first rear opening 119*a* may be disposed backward (right side in FIG. 18) from the second rear opening 119*d*.

That is, the second rear opening 119*d* may be disposed between the front opening 111*a* and the first rear opening 119*a*.

In this embodiment, the sealing part 200 may be made of an elastic material. For example, the sealing part 200 may be made of a rubber or silicon material.

Also, the sealing part 200 includes a first extension portion 215 inserted into the first rear opening 119*a* and a second extension portion 214 inserted into the second rear opening 119*d*.

Also, at least a portion of the sealing part 200 may be elevated in a state in which the first extension portion 215 and the second extension portion 214 are respectively inserted into the first rear opening 119*a* and the second rear opening 119*d*.

A hook protrusion 217 extending horizontally from each of both sides of an upper end of the first extension portion 215 is disposed on the first extension portion 215.

The first extension portion 215 may be elevated without being separated from the first rear opening 119*a* by the hook protrusion 217.

A front-rear length (left-right length in FIG. 18) of the hook protrusion 217 may be greater than a front-rear length (left-right length in FIG. 19) of the first rear opening 119*a*. Accordingly, the hook protrusion 217 may be maintained in a state of being hung on an upper end of both ends defining the first rear opening 119*a*. That is, the hook protrusion 217 may be maintained in a state of being hung on a top surface of a support member 119.

Also, a front-rear length (left-right length in FIG. 18) of the extension portion 215 may be less than or equal to a front-rear length (left-right length in FIG. 18) of the first rear opening 119*a*.

Also, a vertical length of the first extension portion 215 may be longer than a vertical length of the first rear opening 119*a*.

On the other hand, a fixing hook 218 may be disposed on an upper end of the second extension portion 214.

In detail, the fixing hook 218 may be provided with a horizontal portion 218*a* extending backward (right side in FIG. 18) from the upper end of the second extension portion 214 and a vertical portion 218*b* extending downward from an upper end of the horizontal portion 218*a*.

Here, the horizontal portion 218*a* may be inclined upward toward the rear side (right side in FIG. 18).

Also, the housing 110 may have a hook groove 119*e* having a shape that is concave downward from an upper side so that the fixing hook 218 is fitted into an inner surface thereof.

The hook groove 119*e* may be recessed downward from the top surface of the support member 119.

Here, the top surface of the support member 119 may mean an inner surface of the chamber 112.

Also, a support protrusion 119*f* extending upward so that one surface of the vertical portion 218*b* contacts an inner surface thereof may be disposed on an inner surface of the housing 110.

The support protrusion 119*f* may have a flat surface contacting the vertical portion 218*b*. A height of the support protrusion 119*f* may be higher than that of the vertical portion 218*b*.

As described above, when the first extension portion 215 is elevatably connected to the first rear opening 119*a*, and the second extension portion 214 is coupled to the second rear opening 119*d* in a hook manner, the second extension portion 214 may be maintained in a state of being coupled to the housing 110 in the hook manner, and the sealing part 200 may contact the floor surface while the first extension portion 215 is elevated or rotates.

The sealing part 200 includes a sealing pad 213 connecting a lower end of the first extension portion 215 to a lower end of the second extension portion 214, and a sealing groove 211 that is recessed upward from a lower end thereof and parallel to a longitudinal direction of the suction nozzle 100 may be defined in the sealing pad 213.

Also, the sealing groove 211 may be provided in plurality, which are spaced apart from each other in a front-rear direction.

Due to the configuration of the sealing grooves 211, a sealing protrusion 212 protruding downward may be disposed between the sealing grooves 211.

The sealing groove 211 and the sealing protrusion 212 extend in a direction crossing the air inflow direction (a left-right direction in FIG. 18).

Also, the plurality of sealing grooves 211 and sealing protrusions 212 may be provided alternately in a direction parallel to the air inflow direction (the left-right direction in FIG. 18).

(a) of FIG. 18 is a cross-sectional view of the sealing part 200 in which the sealing groove 211 and the sealing protrusion 212 are not provided in/on the sealing pad 213, and (b) of FIG. 18 is a cross-sectional view of the sealing part 200 in which the sealing groove 211 and the sealing protrusion 212 are provided in/on the sealing pad 213.

Referring to (a) of FIG. 18, when suction power is generated in the suction nozzle 100, air is suctioned into the front opening 111*a*, and dust on the floor surface is also suctioned.

Also, air is introduced forward (right side in FIG. 18) from the rear side through the space between the bottom surface of the sealing pad and the floor surface without large resistance, and the front suction force is reduced.

In detail, in the case of (a) of FIG. 18, when air is introduced forward from the rear side through the space between the bottom surface of the sealing pad 213 and the floor surface, only flow resistance due to a sudden decrease occurs.

On the other hand, referring to (b) of FIG. 18, when the air is introduced forward (from the right side to the left side in FIG. 18) from the rear side through the space between the bottom surface of the sealing pad 213 and the floor surface, the air may be introduced while receiving larger resistance by the sealing groove 211 and the sealing protrusion 212, which are disposed in/on the bottom surface of the sealing pad 213, and thus, the front suction force may increase.

In detail, in the case of (b) of FIG. 18, when air is introduced forward from the rear side through a space between the bottom surface and the bottom surface of the sealing pad 213, a rapid decrease in flow resistance and a rapid increase in flow resistance alternately occur by the sealing protrusions 212 and the sealing grooves 211, which are alternately disposed. Also, in each of the sealing grooves 211, an eddy current may be generated, and a differential pressure may be generated by multiple flow resistance, and as a result, a bottom surface pressure may increase while external air inflow resistance increase.

Figure 19:
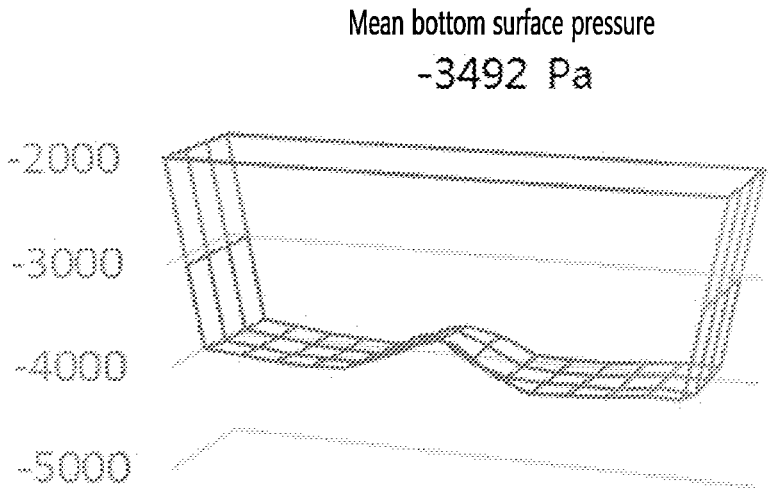
FIG. 19 is a graph obtained by comparing bottom surface pressures when the sealing part of FIG. 18 is applied.
Figure 19:
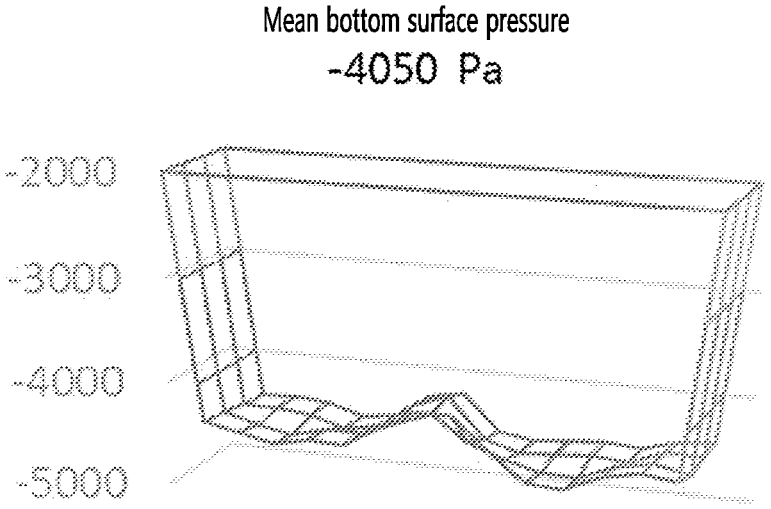

FIG. 19 is a graph obtained by comparing bottom surface pressures when the sealing part of FIG. 18 is applied.

First, (a) of FIG. 19 is a graph illustrating a bottom surface pressure when a flat type sealing part of (a) of FIG. 18 is applied, and (b) of FIG. 19 is a graph illustrating a bottom surface pressure when a pocket sealing type sealing part of (b) of FIG. 18 is applied.

Referring to FIG. 19, when the flat type sealing part as illustrated in (a) of FIG. 18 is applied, the bottom surface pressure is about −3492 Pa, and when the pocket sealing type sealing part as illustrated in (b) of FIG. 18 is applied, the bottom surface pressure is about −4050 Pa. Here, it may be confirmed that the bottom surface pressure increases by about 16% to about 18% when the pocket sealing type sealing part as illustrated in (b) of FIG. 18 is applied in comparison to the case in which the flat type sealing part as illustrated in (a) of FIG. 18 is applied.

Figures 20, 21:
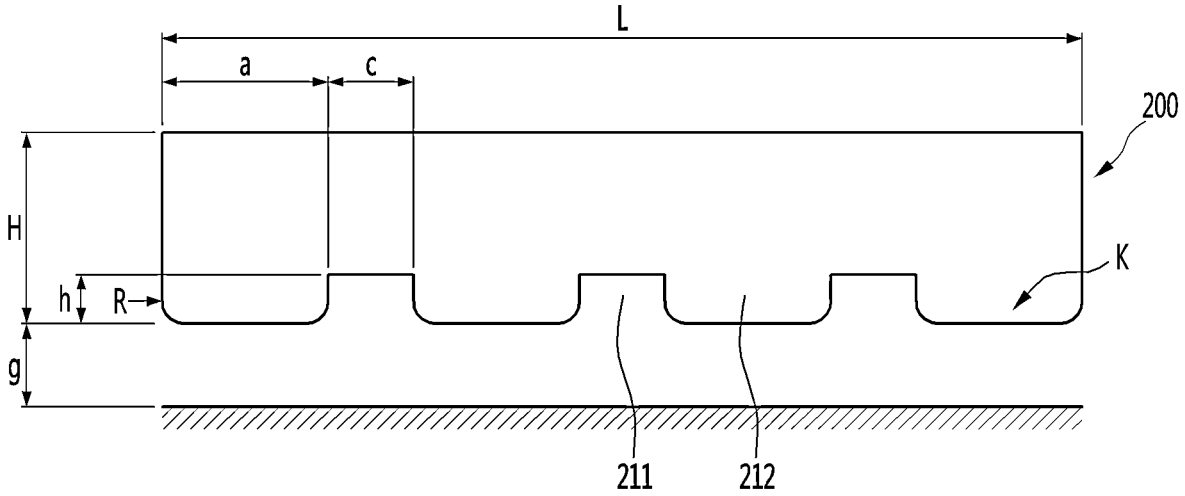
FIG. 20 is a side view of a sealing part that is a main component of the vacuum cleaner according to an embodiment.
FIG. 21 is a table obtained by comparing results of measuring a pressure drop depending on a design change of the sealing part.

FIG. 20 is a side view of a sealing part that is a main component of the vacuum cleaner according to an embodiment.

Referring to FIG. 20, the sealing part 200 has a rectangular cross-section as a whole. Also, a sealing groove 211 that is recessed upward from a lower end and extends in a longitudinal direction of the suction nozzle 100 may be defined in the sealing part 200.

Also, the sealing groove 211 may be provided in plurality, which are spaced apart from each other in a front-rear direction.

Here, the front-rear direction (left-right direction in FIG. 20) may mean a direction in which air is suctioned.

As described above, when the plurality of sealing grooves 211 are defined in the bottom surface of the sealing part 200, a sealing protrusion 212 may be provided between the sealing grooves 211.

The sealing grooves 211 and the sealing protrusions 212 may be alternately provided in a front-rear direction (left-right direction in FIG. 20).

Referring to FIG. 20, a height h of the sealing groove 211 may be set in a range of about 0.5 mm to about 2 mm.

Also, a front-rear direction b of the sealing groove 211 may be greater than that a of the sealing protrusion 212.

For example, a ratio a/b of the front-rear length a of the sealing protrusion 212 and the front-rear length b of the sealing groove 211 may be set in a range of about 0.3 to about 0.8.

As another example, a ratio a/b of the front-rear length a of the sealing protrusion 212 and the front-rear length b of the sealing groove 211 may be set to about 0.5.

FIG. 21 is a table obtained by comparing results of measuring a pressure drop depending on a design change of the sealing part.

Referring to FIG. 21, in cases 1 to 19, a front-rear length L of the sealing part 200 is about 16 mm, a height H of the sealing part 200 is about 2.5 mm, a distance g between the floor surface and a lower end of the sealing protrusion 212 is about 1.5 mm, and a corner curvature R of the sealing protrusion 212 is about 0.4 mm.

First, the case 1 is case in which the sealing groove 211 and the sealing protrusion 212 are not provided in/on the sealing part. Here, a pressure drop is measured to about 32.5 Pa.

For reference, the pressure drop may mean a difference between pressures measured at the front and rear ends of the sealing part 200 during the suction operation of the suction nozzle 100.

Here, the front end of the sealing part 200 means one side adjacent to the front opening 111*a*, and the rear end of the sealing part 200 means the other side adjacent to the connection tube 120.

Therefore, when the pressure drop is large, it is understood that flow resistance of the air introduced forward from the rear side is large, and the rear sealing is more surely performed.

Therefore, the cleaning performance and the pressure drop are proportional to each other.

Referring to FIG. 21, in the cases 4 and 13, the pressure drop is measured to the largest value.

First, in the case 4, the number K of sealing protrusions 212 is four, a height h of the sealing groove 211 is about 0.9 mm, a front-rear length a of the sealing protrusion 212 is about 1.6 mm, and a front-rear length b of the sealing groove 211 is about 3.2 mm.

Also, in the case 13, the number K of sealing protrusions 212 is five, a height h of the sealing groove 211 is about 0.9 mm, a front-rear length a of the sealing protrusion 212 is about 1.2 mm, and a front-rear length b of the sealing groove 211 is about 2.4 mm.

commonly, it may be confirmed that a ratio a/b of a front-rear length a of the sealing protrusion 212 and a front-rear length b of the sealing groove 211 is about 0.5.

On the other hand, when the front-rear length b of the sealing groove 211 and the front-rear length a of the sealing protrusion 212 are the same, or the front-rear length b of the sealing groove 211 is less than the front-rear a of the sealing protrusion 212, it may be confirmed that the pressure drop is rather reduced.

Therefore, the front-rear direction b of the sealing groove 211 has to be greater than that a of the sealing protrusion 212.

Also, in the cases 4 and 13, it may be seen that the height h of the sealing groove 211 is about 0.9 mm.

On the other hand, when the height h of the sealing groove 211 is about 1.9 mm or about 2.9 mm under the condition in which the front-rear length b of the sealing groove 211 and the front-rear length a of the sealing protrusion 212 are the same, it may be confirmed that the pressure drop is rather reduced.

Therefore, the height h of the sealing groove 211 may be set in a range of about 0.5 mm to about 2 mm.

Also, referring to FIG. 21, a ratio h/b of the front-rear direction b of the sealing groove 211 and the height h of the sealing groove 211 may be set in a range of about 0.2 to about 0.4.

Also, referring to FIG. 21, a ratio h/a of the front-rear length a of the sealing protrusion 212 and the height h of the sealing groove 211 may be set in a range of about 0.5 to about 0.8.

Figure 22:
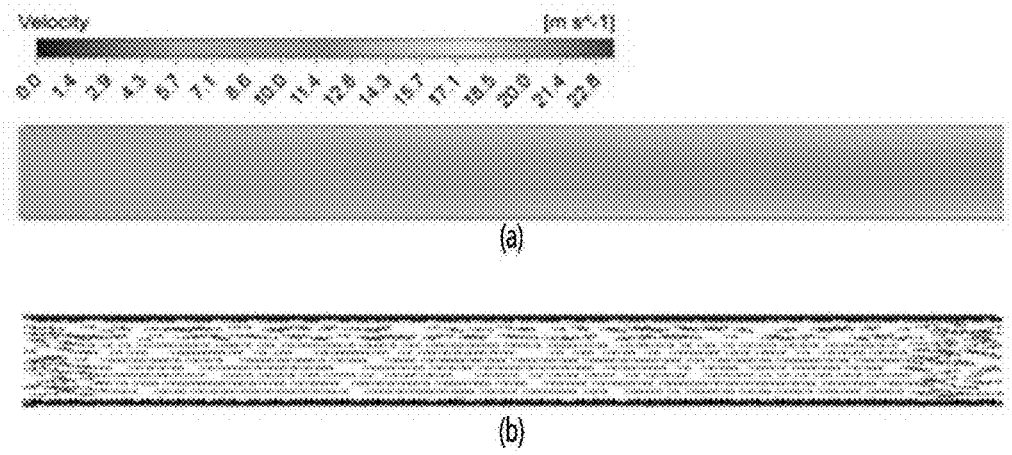
FIG. 22 is a view of a flow analysis result in the sealing part according to a case 1 of FIG. 21.
Figure 23:
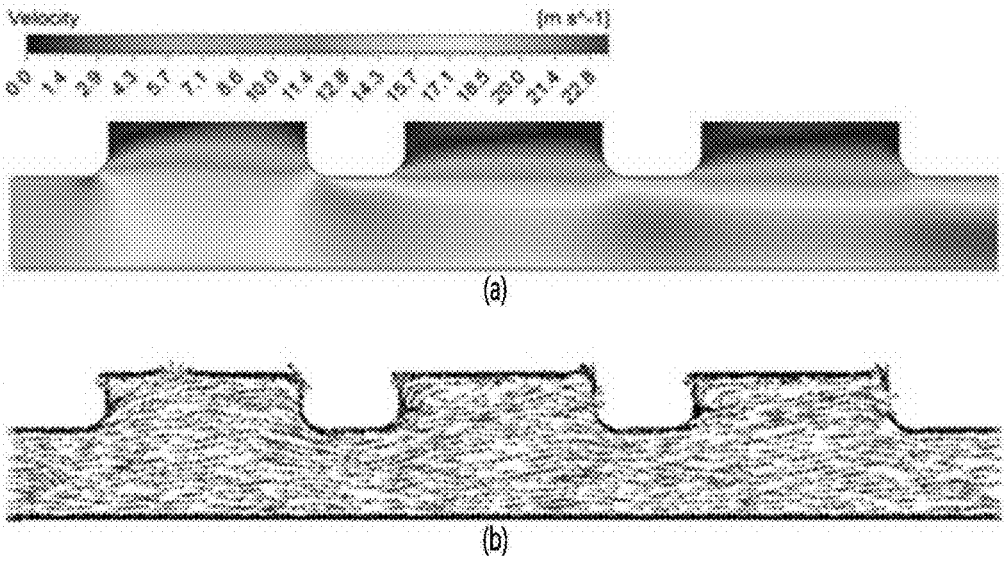
FIG. 23 is a view of a flow analysis result in the sealing part according to a case 4 of FIG. 21.

FIG. 22 is a view of a flow analysis result in the sealing part according to the case 1 of FIG. 21. FIG. 23 is a view of a flow analysis result in the sealing part according to the case 4 of FIG. 21, and FIG. 24 is a view of a flow analysis result in the sealing part according to the case 13 of FIG. 21.

Figure 24:
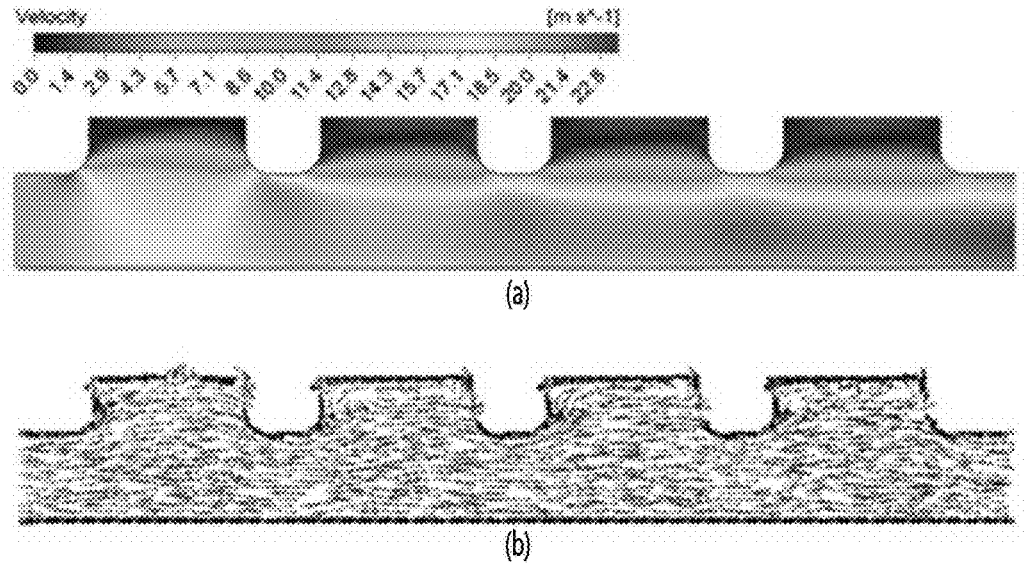
FIG. 24 is a view of a flow analysis result in the sealing part according to a case 13 of FIG. 21.

Referring to FIGS. 22 to 24, in the case of FIGS. 23 and 24 in comparison to FIG. 22, it may be confirmed that flow resistance occurs while vortex occurs between the sealing part and the floor surface.

Particularly, it may be confirmed that the pressure drop occurs while a flow velocity decreases from the front side (left side in FIG. 23) to the rear side (right side in FIG. 23) of the sealing part.

Figure 25:
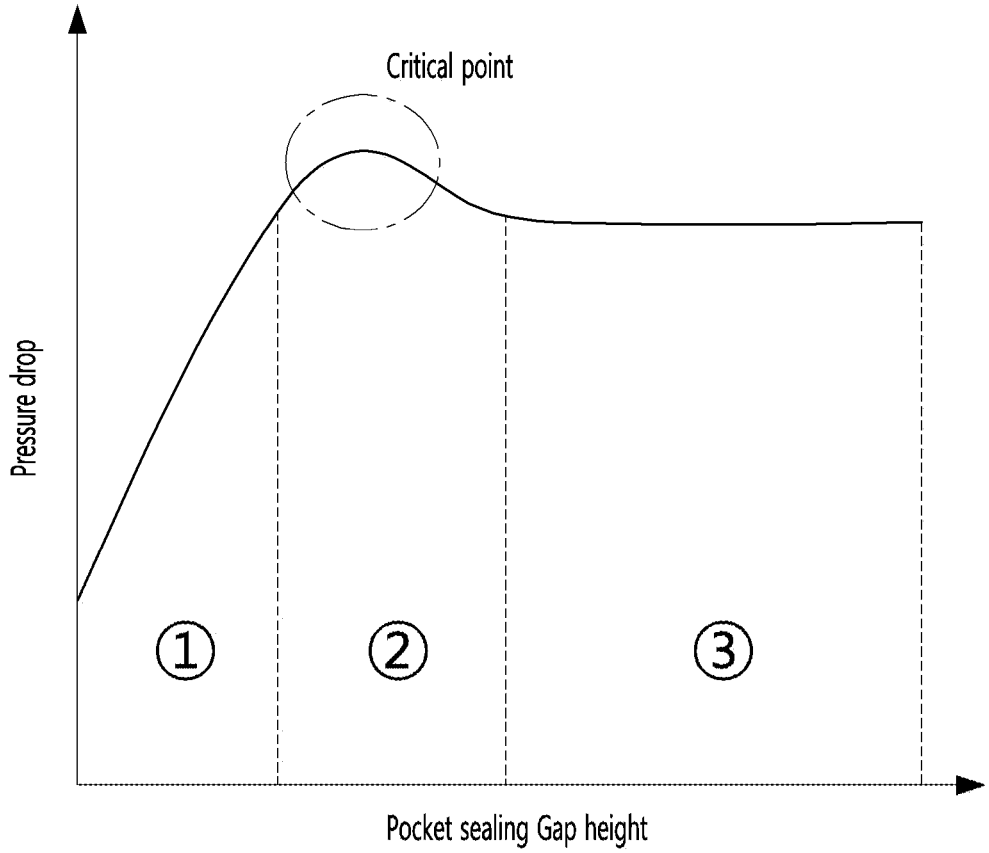
FIG. 25 is a graph of a variation in pressure drop depending on a change in height of a sealing groove.

FIG. 25 is a graph of a variation in pressure drop depending on a change in height of the sealing groove. Also, FIG. 26 is a view of a flow analysis result depending on a height of the sealing groove in a first section of FIG. 25, FIG. 27 is a view of a flow analysis result depending on a height of the sealing groove in a second section of FIG. 25, and FIG. 28 is a view of a flow analysis result depending on a height of the sealing groove in a first section of FIG. 25.

Figure 26:
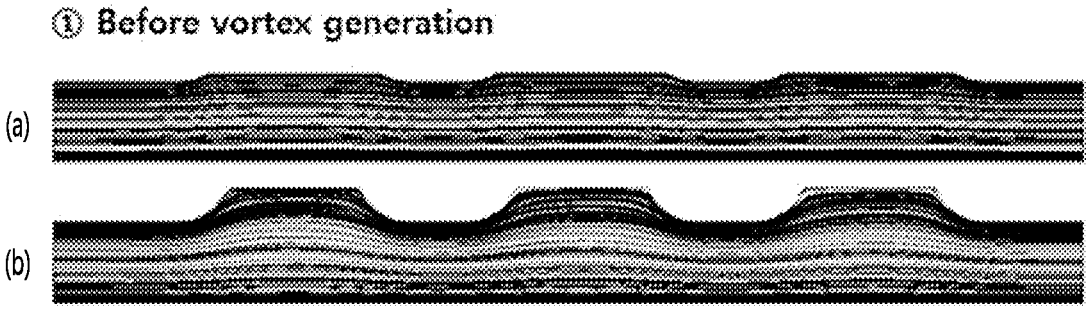
FIG. 26 is a view of a flow analysis result depending on a height of the sealing groove in a first section of FIG. 25.

Referring to FIGS. 24 and 26, it may be confirmed that, in the first section, as the height of the sealing groove increases, the pressure drop also increases.

In detail, in the first section, it may be confirmed that, in the case of (b) of FIG. 26, in which the height of the sealing groove increases in comparison to (a) of FIG. 26, in which the height of the sealing groove is relatively low, the flow velocity is reduced.

Figure 27:
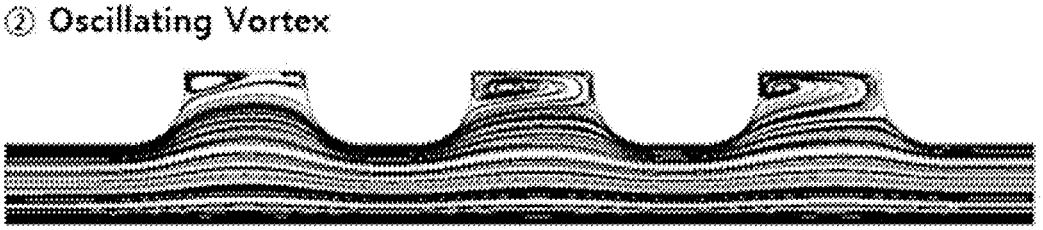
FIG. 27 is a view of a flow analysis result depending on a height of the sealing groove in a second section of FIG. 25.
Figure 28:
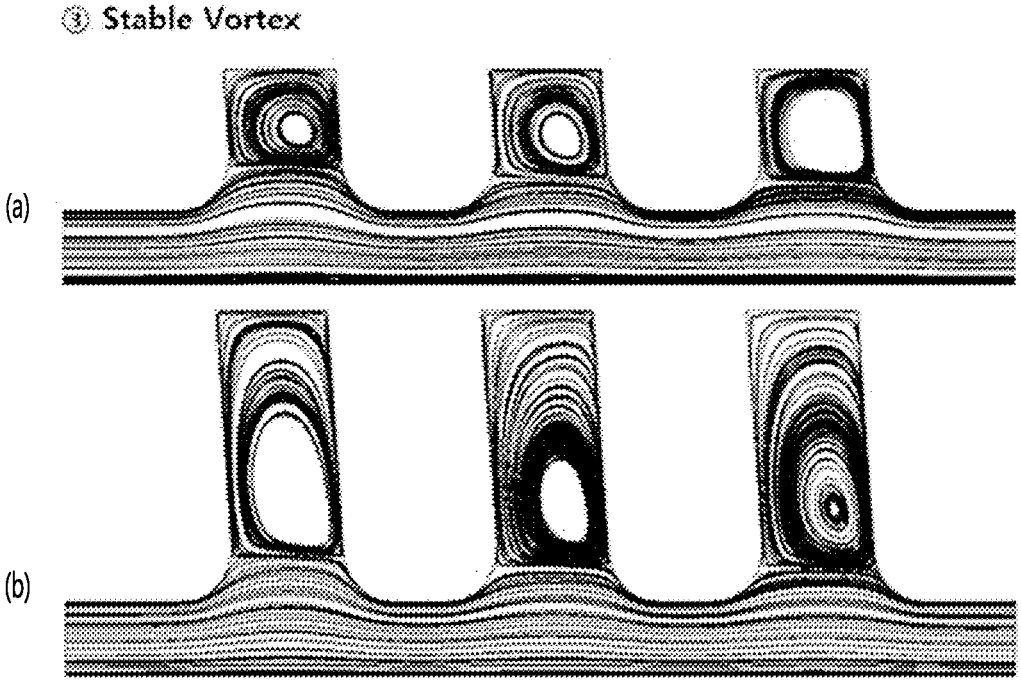
FIG. 28 is a view of a flow analysis result depending on a height of the sealing groove in a first section of FIG. 25.

On the other hand, referring to FIGS. 24 and 27, it may be confirmed that, after the first section, in the second section, as the height of the sealing groove increases, the pressure drop also increases, and then, the pressure drop is rather reduced.

Also, referring to FIGS. 24 and 28, in the third section of the second section, even if the height of the sealing groove increases, it may be confirmed that the pressure drop is constantly maintained.

In detail, in the third section, it may be confirmed that, in the case of (b) of FIG. 28, in which the height of the sealing groove increases in comparison to (a) of FIG. 28, in which the height of the sealing groove is relatively low, the flow velocity is hardly changed.

Referring to FIGS. 25 to 28, in the case of the first region and the second region, it may be confirmed that an unstable flow occurs in all the regions, and as the differential pressure of the sealing groove 211 increases due to the unstable vortex, the frictional resistance increases. As a result, the bottom surface pressure may increase while inflow resistance of external air increases.

On the other hand, in the case of the third region, it may be confirmed that the frictional resistance is rather reduced while the surface exchange disappears very quickly.

According to the present invention as described above, the flow of the fluid flowing forward from the rear side of the suction nozzle when the cleaner operates may not be simply blocked, but the multi-stage resistance may be generated in the passage of the fluid flowing forward from the rear side to reduce the flow velocity and rate of the fluid flowing forward from the rear side, resulting in concentrating the suction force, thereby allowing the front suction force to increase.

The above-described vacuum cleaner is not limited to the constituent and method according to the foregoing embodiments, but the embodiments may be configured such that all or some of the embodiments are selectively combined with each other.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vacuum cleaner comprising:

a cleaner body having a suction motor provided therein;

a handle connected to an outside surface of the cleaner body; and a suction nozzle connected to the cleaner body, wherein the suction nozzle comprises:

a housing having at least a portion of a front side thereof that is open to define a front opening;

a rotation cleaning part configured to clean a floor surface by a rotation operation thereof, the rotation cleaning part disposed inside the housing and having at least a portion thereof exposed through the front opening, and a sealing part protruding downward from a lower end of the housing and provided behind the front opening, the sealing part comprising a sealing groove recessed upward from a lower end thereof and a sealing protrusion protruding downward from the lower end thereof, and wherein the sealing part is elevatably connected to a rear portion of the suction nozzle, wherein at least a portion of a rear side of the housing is open to define a rear opening, wherein the housing comprises a first side surface to define the rear opening and a second side surface spaced backward from the first side surface and facing the first side surface, wherein the sealing part comprises a first extension portion and a second extension portion, the first and second extension portions extending upward and supported on the first side surface and the second side surface, respectively, wherein the sealing part comprises a sealing pad to connect a lower end of the second extension portion to a lower end of the first extension portion, and wherein the sealing groove is formed in the sealing pad, the sealing groove recessed upward from a lower end of the sealing pad and extending parallel to a longitudinal direction of the suction nozzle.

2. The vacuum cleaner according to claim 1, wherein the sealing groove is provided in plurality, the plurality of sealing grooves are spaced apart from each other in a front-to-rear direction of the sealing part.

3. The vacuum cleaner according to claim 2, wherein the sealing protrusion is disposed between each of the plurality of sealing grooves, and wherein a ratio (a/b) of a front-rear length (a) of the sealing protrusion and a front-rear length (b) of the sealing groove is 0.3 to 0.8.

4. The vacuum cleaner according to claim 1, wherein the sealing part comprises a plurality of sealing protrusions, each of the plurality of sealing protrusions protruding downward from an upper side and extending parallel to a longitudinal direction of the suction nozzle, whereby the plurality of sealing protrusions are spaced apart from each other in a front-to-rear direction of the sealing part.

5. The vacuum cleaner according to claim 4, wherein the sealing protrusion disposed at a rear side of the sealing part protrudes further downward than the sealing protrusion disposed at a front side of the sealing part.

6. The vacuum cleaner according to claim 1, wherein the sealing part is elevated when the second extension portion and the first extension portion contact the first side surface and the second side surface, respectively.

7. The vacuum cleaner according to claim 1, wherein the sealing part further comprises a third extension portion extending backward from the lower end of the second extension portion.

8. The vacuum cleaner according to claim 7, wherein the sealing pad connects a lower end of the third extension portion and the lower end of the first extension portion.

9. The vacuum cleaner according to claim 1, wherein at least a portion of a rear side of the housing is open to define the rear opening, and wherein the rear opening comprises a first rear opening and a second rear opening that is disposed behind the first rear opening, and wherein the sealing part comprises a first extension portion inserted into the first rear opening and a second extension portion inserted into the second rear opening.

10. The vacuum cleaner according to claim 1, wherein the sealing part contacts the floor surface while descending by a differential pressure when suction force is generated in the suction nozzle, and wherein, when the sealing part descends, a lowermost end of the sealing part is disposed lower than a lowermost end of the front opening.

11. The vacuum cleaner according to claim 1, wherein the sealing part comprises an elastic material or a flexible material.

12. The vacuum cleaner according to claim 1, wherein the suction nozzle comprises a connection tube that is connected to the cleaner body and disposed behind the housing, whereby the sealing part is disposed between the front opening and the connection tube.

13. The vacuum cleaner according to claim 1, wherein the housing comprises:

a body part in which the front opening is defined in a front side thereof, and a chamber communicably coupled with the front opening is provided therein and which is configured to cover an upper side of the rotation cleaning part; and a support member provided below the body part, wherein the sealing part is provided on a bottom surface of the support member, and wherein a front end of the body part and a front end of the support member define the front opening.

14. A vacuum cleaner comprising:

a cleaner body having a suction motor provided therein;

a handle connected to an outside surface of the cleaner body; and a suction nozzle connected to the cleaner body, wherein the suction nozzle comprises:

a housing having at least a portion of a front side thereof that is open to define a front opening;

a rotation cleaning part configured to clean a floor surface by a rotation operation thereof, the rotation cleaning part disposed inside the housing and having at least a portion thereof exposed through the front opening, and a sealing part protruding downward from a lower end of the housing and provided behind the front opening, the sealing part comprising at least one of a sealing groove recessed upward from a lower end thereof or a protrusion protruding downward from the lower end thereof, wherein the sealing part is elevatably connected to a rear portion of the suction nozzle, wherein at least a portion of a rear side of the housing is open to define a rear opening, and wherein the rear opening comprises a first rear opening and a second rear opening that is disposed behind the first rear opening, wherein the sealing part comprises a first extension portion inserted into the first rear opening and a second extension portion inserted into the second rear opening, and wherein a hook protrusion extending horizontally from each of a front side and a back side of an upper end of the first extension portion is disposed on the first extension portion.

15. The vacuum cleaner according to claim 14, further comprising an elevation part, wherein the elevation part comprises a fixing hook constituted by a horizontal portion backward from an upper end of the second extension portion and a vertical portion extending downward from an end of the horizontal portion, and a hook groove formed in the housing, the hook groove recessed downward and configured to receive the fixing hook in an inner surface thereof.

16. The vacuum cleaner according to claim 14, wherein the sealing part comprises a sealing pad that connects a lower end of the first extension portion to a lower end of the second extension portion, and the sealing groove is formed in the sealing pad, the sealing groove recessed upward from a lower end of the sealing pad and extending parallel to a longitudinal direction of the suction nozzle.

17. The vacuum cleaner according to claim 14, wherein the sealing groove is provided in plurality, the plurality of sealing grooves are spaced apart from each other in a front-rear direction of the sealing part.

* * * * *